US011162344B2

(12) United States Patent
Alharbi

(10) Patent No.: US 11,162,344 B2
(45) Date of Patent: Nov. 2, 2021

(54) ACID FRACTURING TREATMENTS IN HYDROCARBON-BEARING FORMATIONS IN CLOSE PROXIMITY TO WET ZONES

(71) Applicant: Saudi Arabian Oil Company, Dhahran (SA)

(72) Inventor: Moataz Mohammad Alharbi, Udhailiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 114 days.

(21) Appl. No.: 16/459,490

(22) Filed: Jul. 1, 2019

(65) Prior Publication Data

US 2021/0002992 A1 Jan. 7, 2021

(51) Int. Cl.

| | |
|---|---|
| ***E21B 43/26*** | (2006.01) |
| ***E21B 33/138*** | (2006.01) |
| ***E21B 43/14*** | (2006.01) |
| ***E21B 49/00*** | (2006.01) |

(52) U.S. Cl.

CPC ..... *E21B 43/26* (2013.01); *E21B 33/138* (2013.01); *E21B 43/14* (2013.01); *E21B 49/00* (2013.01)

(58) Field of Classification Search

CPC ..... E21B 43/14; E21B 43/26; E21B 43/267; E21B 33/138; E21B 49/00

See application file for complete search history.

(56) References Cited

U.S. PATENT DOCUMENTS

| | | | | |
|---|---|---|---|---|
| 2,265,962 | A | 12/1941 | Bent et al. | |
| 4,397,353 | A * | 8/1983 | Lacy | E21B 33/138 166/269 |
| 4,476,931 | A | 10/1984 | Boles | |
| 4,887,670 | A | 12/1989 | Lord et al. | |
| 5,018,578 | A * | 5/1991 | El Rabaa | E21B 43/162 166/281 |
| 5,425,421 | A | 6/1995 | Coleman et al. | |
| 10,907,457 | B2 | 2/2021 | Alharbi | |
| 2014/0338914 | A1 | 11/2014 | Clements | |
| 2015/0034308 | A1 | 2/2015 | Blair et al. | |
| 2017/0284180 | A1 * | 10/2017 | Switzer | C09K 8/70 |
| 2018/0238153 | A1 | 8/2018 | Nevison | |
| 2021/0002993 | A1 | 1/2021 | Alharbi | |
| 2021/0156239 | A1 | 5/2021 | Alharbi | |

OTHER PUBLICATIONS

Abbas et al., "Assessment of Pilot Water Shut Off in High Water Production Wells: Case Study in Sudan," International Journal of Petrochemical Science and Engineering, Jan. 2017, 5 pages.

(Continued)

*Primary Examiner* — David Carroll

(74) *Attorney, Agent, or Firm* — Fish & Richardson P.C.

(57) ABSTRACT

System, methods, and devices for simultaneously fracturing a target formation and an adjacent secondary formation are disclosed. The simultaneous fracturing operations interfere with each other to form in-situ dynamic barriers. The in-situ barriers prevent acid from the fracturing treatment in the target formation from invading the secondary formation and, in some instances, sealing formation rock at the location of the in-situ barrier to prevent or reduce water movement from the secondary formation into the primary formation.

10 Claims, 12 Drawing Sheets

(56) References Cited

OTHER PUBLICATIONS

Independent Oil Producers, "Analysis of Petroleum Technology Advances through Applied Research," sponsored by U.S. Department of Energy National Petroleum Technology Office, Tulsa, Oklahoma, Nov. 1999, 153 pages.
Salah et al., "Best Practices and Lessons Learned from more than 1,000 Treatments: Revival and Mature Fields by Hydraulic Fracturing in Khalda Ridge, Egypt's Western Desert," PE-181353-MS, presented at the SPE Annual Technical Conference and Exhibition in Dubai, UAE, Sep. 2628, 2016, 45 pages.
PCT International Search Report and Written Opinion in International Application No. PCT/US2020/040,128, dated Oct. 12, 2020, 13 pages.
PCT International Search Report and Written Opinion in International Application No. PCT/US2020/040,134, dated Oct. 12, 2020, 15 pages.

* cited by examiner

ACID FRACTURING TREATMENTS IN HYDROCARBON-BEARING FORMATIONS IN CLOSE PROXIMITY TO WET ZONES

TECHNICAL FIELD

The present disclosure relates to hydraulic fracturing of subsurface reservoirs.

BACKGROUND

Production from hydrocarbon-bearing formations formed of carbonate materials may be enhanced with an acid fracturing treatment. The acid applied to the formation dissolves portions of the formation material thereby forming "wormholes." The wormholes extend into the formation and form passages that enhance the production of the hydrocarbons within the formation. However, a formation that has adjacent wet zones may be problematic and may preclude use of acid fracturing. In such instances, an acid fracturing treatment may form wormholes that extend into one or more of the wet zones and create pathways for water. As a result, the acid fracturing treatment may increase water production and potentially cause a well extending into the formation to no longer be economically feasible.

SUMMARY

A first aspect of the present disclosure is directed to a method of performing simultaneous and competing fracturing operations in adjacent formations to form in-situ dynamic barriers between the competing fracturing treatments. The method may include perforating an interval of a target formation; determining a mid-perforation separation distance extending from a center of the target formation perforated interval to a center of a perforation interval to be formed in a secondary formation; perforating an interval of the secondary formation, a center of the perforated interval formed in the secondary formation being separated from the center of the perforated interval of the target formation by the mid-perforation separation distance such that a fracture to be formed in the target formation overlaps a fracture to be formed in the secondary formation; and applying, simultaneously, a first fracturing treatment to the perforated interval of the target formation and a second fracturing treatment to the perforated interval of the secondary formation. The secondary formation may include a first wet zone. The first fracturing treatment may include an acid fracturing treatment. The second fracturing treatment may include a neutralizing additive and a sealing agent additive. The method may also include growing a first fracture formed by the first fracturing treatment and a second fracture formed by the second fracturing treatment to cause the first fracture and the second fracture to interfere with each other thereby forming in-situ dynamic barriers. The neutralizing additive may neutralize acid of the acid fracturing treatment to prevent intrusion of the acid into the secondary formation. The sealing agent additive may seal formation rock at a location of the in-situ dynamic barrier to alter water conductivity in the sealed formation rock.

A second aspect of the present disclosure is directed to an apparatus for performing simultaneous and competing fracturing operations in adjacent formations to form in-situ dynamic barriers between the competing fracturing treatments. The apparatus includes one or more processors and a non-transitory computer-readable storage medium coupled to the one or more processors and storing programming instructions for execution by the one or more processors. The programming instructions may instruct the one or more processors to: perforate an interval of a target formation; determine a mid-perforation separation distance extending from a center of the target formation perforated interval to a center of a perforation interval to be formed in a secondary formation; perforate an interval of the secondary formation, a center of the perforated interval formed in the secondary formation being separated from the center of the perforated interval of the target formation by the mid-perforation separation distance such that a fracture to be formed in the target formation overlaps a fracture to be formed in the secondary formation; apply, simultaneously, a first fracturing treatment to the perforated interval of the target formation and a second fracturing treatment to the perforated interval of the secondary formation; and grow a first fracture formed by the first fracturing treatment and a second fracture formed by the second fracturing treatment to cause the first fracture and the second fracture to interfere with each other thereby forming in-situ dynamic barriers. The secondary formation may include a first wet zone. The first fracturing treatment may include an acid fracturing treatment. The second fracturing treatment may include a neutralizing additive and a sealing agent additive. The neutralizing additive may neutralize the acid of the acid fracturing treatment to prevent intrusion of the acid into the secondary formation, and the sealing agent additive may seal formation rock at a location of the in-situ dynamic barrier to alter water conductivity in the sealed formation rock.

A third aspect of the present disclosure is directed to a computer-implemented method performed by one or more processors for performing simultaneous and competing fracturing operations in adjacent formations to form in-situ dynamic barriers between the competing fracturing treatments. The method may include the operations of: perforating an interval of a target formation; determining a mid-perforation separation distance extending from a center of the target formation perforated interval to a center of a perforation interval to be formed in a secondary formation; perforating an interval of the secondary formation; applying, simultaneously, a first fracturing treatment to the perforated interval of the target formation and a second fracturing treatment to the perforated interval of the secondary formation; and growing a first fracture formed by the first fracturing treatment and a second fracture formed by the second fracturing treatment to cause the first fracture and the second fracture to interfere with each other thereby forming in-situ dynamic barriers. The secondary formation may include a first wet zone. A center of the perforated interval formed in the secondary formation may be separated from the center of the perforated interval of the target formation by the mid-perforation separation distance such that a fracture to be formed in the target formation overlaps a fracture to be formed in the secondary formation. The first fracturing treatment may include an acid fracturing treatment. The second fracturing treatment may include a neutralizing additive and a sealing agent additive. The neutralizing additive neutralizing acid of the acid fracturing treatment may prevent intrusion of the acid into the secondary formation, and the sealing agent additive may seal formation rock at a location of the in-situ dynamic barrier to alter water conductivity in the sealed formation rock.

The different aspects may include one or more of the following features. Perforating the interval of the target formation and perforating the interval of the secondary formation may be performed at respective locations along a vertical well. The mid-perforation separation distance may be determined according to the following relationships:

$S1 \leq R+(Z/2)$; and $S1 \leq 2R$, or according to the following equations:

$S1 \leq (H/2)+(Z/2)$;

$S1 \leq H$; and $R<(H/2)$, where S1 is the mid-perforation separation distance; R is a fracture half-length of a fully developed fracture formed in the target formation as a result of the first fracturing treatment; H is a height of the fully developed fracture in the target formation as a result of the first fracturing treatment; and Z is a length of the perforated interval of the primary formation.

The different aspects may also include one or more of the following features. The target formation may be a carbonate formation. The acid may be selected from a group consisting of hydrochloric acid (HCl), emulsified HCl, retarded acid systems, acetic acid, formic acid, and chelating agents. The neutralizing additive may be selected from a group consisting of calcium carbonate, sodium hydroxide, soda ash, and sodium carbonate. The sealing agent additive may be selected from the group consisting of Portland cement, aluminate cement, epoxy resin, phenolic resin, natural rubber, latex, and silicone. The secondary formation may be a first secondary formation. A mid-separation distance extending from the center of the perforated interval of the target formation to a center of a perforated interval to be formed in a second secondary formation may be determined. The second secondary formation may include a second wet zone. The mid-perforation separation distance may be determined according to the following relationships:

$S1 \leq R+(Z/2)$;

$S1 \leq 2R$; and $S1=S2$, or according to the following equations:

$S1 \leq (H/2)+(Z/2)$;

$S1 \leq H$;

$S1=S2$, where S1 is the mid-perforation separation distance extending from the center of the perforated interval of the target formation and the center of the perforated interval formed in the first secondary formation; S2 is the mid-perforation separation distance extending from the center of the perforated interval of the target formation and a center of the perforated interval to be formed in the second secondary formation; R is a fracture half-length of a fully developed fracture formed in the target formation as a result of first fracturing treatment; H is a height of the fully developed fracture in the target formation as a result of the first fracturing treatment; and Z is a length of the perforated interval of the primary formation.

An interval of the second secondary formation disposed on a side of the target formation opposite the first secondary formation may be perforated. The center of the perforated interval of the second secondary formation may be offset from the perforated interval of the target formation by the mid-perforation separation distance S2. A third fracturing treatment may be applied to the perforated interval of the second secondary formation. The third fracturing treatment may be performed simultaneously with the first fracturing treatment and the second fracturing treatment. The first fracturing treatment may include an acid fracturing treatment. The second fracturing treatment may include a neutralizing additive and a sealing agent additive. The third fracturing treatment may include a neutralizing additive and a sealing agent additive.

The different aspects may also include one more of the following features. The perforated interval of the target formation and perforated interval of the secondary formation may be formed at respective locations along a vertical well. The mid-perforation separation distance may be determined according to the following relationships:

$S1 \leq R+(Z/2)$; and $S1 \leq 2R$, or according to the following equations:

$S1 \leq (H/2)+(Z/2)$;

$S1 \leq H$; and $R>(H/2)$, where S1 is the mid-perforation separation distance; R is a fracture half-length of a fully developed fracture formed in the target formation as a result of the first fracturing treatment; H is a height of the fully developed fracture in the target formation as a result of the first fracturing treatment; and Z is a length of the perforated interval of the primary formation. The target formation may be a carbonate formation. The acid may be selected from a group consisting of hydrochloric acid (HCl), emulsified HCl, retarded acid systems, acetic acid, formic acid, and chelating agents. The neutralizing additive may be selected from a group consisting of calcium carbonate, sodium hydroxide, soda ash, and sodium carbonate. The sealing agent additive may be selected from the group consisting of Portland cement, aluminate cement, epoxy resin, phenolic resin, natural rubber, latex, and silicone. The secondary formation may be a first secondary formation, and a mid-separation distance extending from the center of the perforated interval of the target formation to a center of a perforated interval to be formed in a second secondary formation may be determined. The second secondary formation may include a second wet zone. The mid-perforation separation distance may be determined according to the following relationships:

$S1 \leq R+(Z/2)$;

$S1 \leq 2R$; and $S1=S2$, or according to the following equations:

$S1 \leq (H/2)+(Z/2)$;

$S1 \leq H$; and $S1=S2$;

$R>(H/2)$, where S1 is the mid-perforation separation distance extending from the center of the perforated interval of the target formation and the center of the perforated interval formed in the first secondary formation; S2 is the mid-perforation separation distance extending from the center of the perforated interval of the target formation and a center of the perforated interval to be formed in the second secondary formation; R is a fracture half-length of a fully developed fracture formed in the target formation as a result of first fracturing treatment; H is a height of the fully developed fracture in the target formation as a result of the first fracturing treatment; and Z is a length of the perforated interval of the primary formation.

The various aspects may also include one or more of the following features. The programming instructions may be operable to instruct the one or more processors to perforate an interval of the second secondary formation disposed on a side of the target formation opposite the first secondary formation. The center of the perforated interval of the second secondary formation may be offset from the perforated interval of the target formation by the mid-perforation separation distance S2. The programming instructions may be operable to instruct the one or more processors to perform a third fracturing treatment to the perforated interval of the second secondary formation. The third fracturing treatment may be performed simultaneously with the first fracturing treatment and the second fracturing treatment. The first fracturing treatment may include an acid fracturing treatment. The second fracturing treatment may include a neutralizing additive and a sealing agent additive. The third fracturing treatment may include a neutralizing additive and a sealing agent additive.

The details of one or more embodiments of the present disclosure are set forth in the accompanying drawings and the description that follows. Other features, objects, and advantages of the present disclosure will be apparent from the description and drawings, and from the claims.

DESCRIPTION OF DRAWINGS

Like reference symbols in the various drawings indicate like elements.

DETAILED DESCRIPTION

Figure 1:
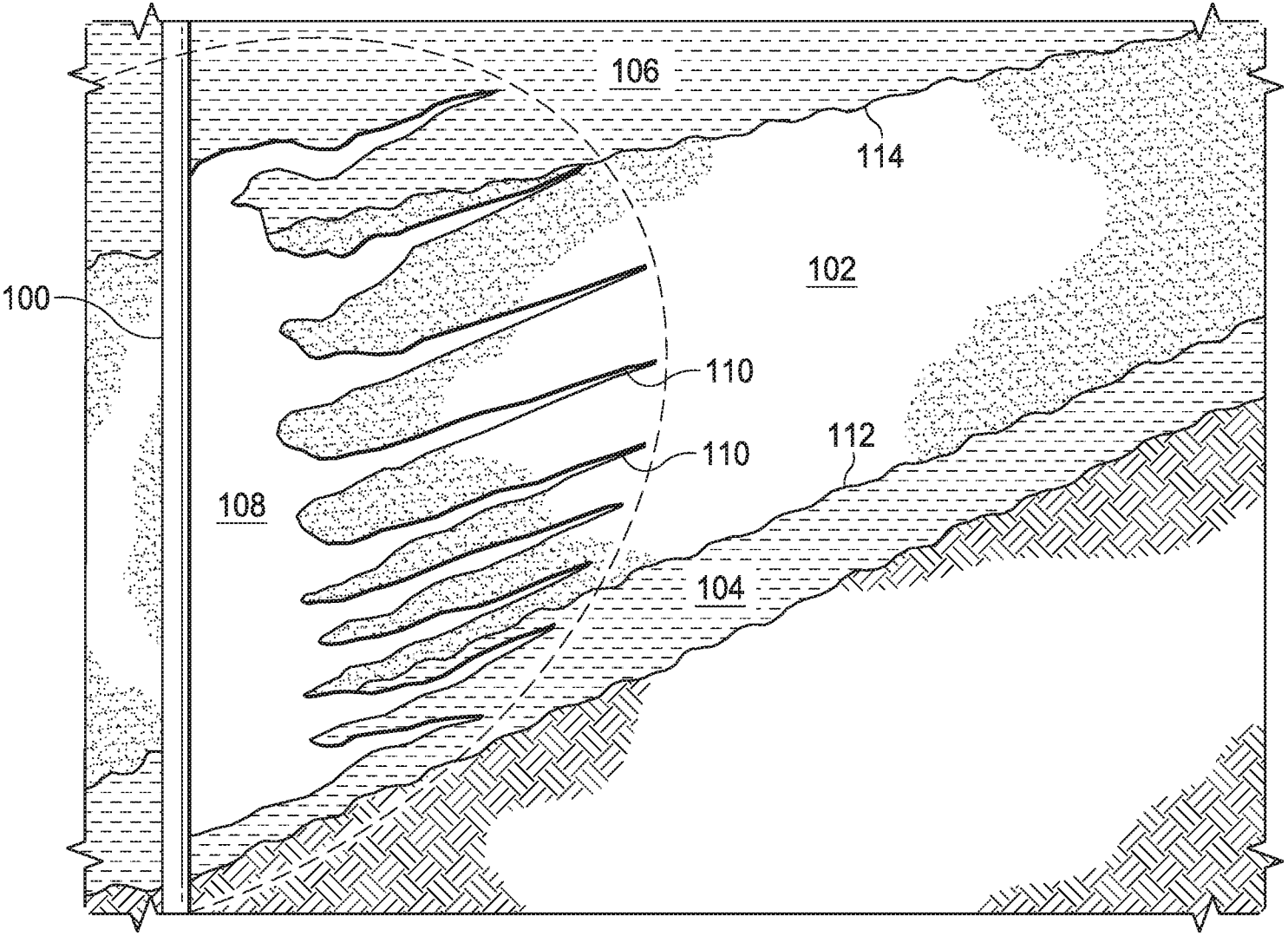
FIG. 1 is a view of a formation in which a fracture is formed as a result of an acid fracturing treatment, according to some implementations of the present disclosure.

For the purposes of promoting an understanding of the principles of the present disclosure, reference will now be made to the implementations illustrated in the drawings, and specific language will be used to describe the same. Nevertheless, no limitation of the scope of the disclosure is intended. Any alterations and further modifications to the described devices, systems, methods, and any further application of the principles of the present disclosure are fully contemplated as would normally occur to one skilled in the art to which the disclosure relates. In particular, it is fully contemplated that the features, components, steps, or a combination of such described with respect to one implementation may be combined with the features, components, steps, or a combination of such described with respect to other implementations of the present disclosure.

The present disclosure is directed to acid fracturing carbonate formations in order to enhance hydrocarbon production and, more particularly, to applying simultaneous is-situ dynamic barriers in or near the target formation during the acid fracturing treatment.

For carbonate formations, acid is used to etch rock that forms the formation and create wormholes. Example acids that may be used include hydrochloric acid (HCl), emulsified HCl acid, retarded acid systems, organic acids, such as acetic or formic acid, and chelating agents. Retarded acid systems provide for low reaction rates, allowing the acid to travel deep into a reservoir before becoming completely spent. FIG. 1 shows a vertical well 100 extending into target formation 102. A first wet zone 104 in an adjacent secondary formation is disposed vertically below or downhole of the target formation 102, and a second wet zone 106 disposed in another secondary formation is disposed vertically above or uphole of the target formation. The target formation 102 lacks natural stress barriers between the target formation and the adjacent wet zones 106 and 104. A fracture wing or fracture 108 is formed in target carbonate formation 102. The fracture 108 is formed by an acid fracturing treatment. As a result, the fracture 108 includes wormholes 110 extending into the target formation 102 and the first and second wet zones 104 and 106. A first boundary 112 is disposed between the target formation 102 and the first wet zone 104. A second boundary 114 is disposed between the target formation and second wet zone 106. As mentioned earlier, the wormholes 110 extending into a wet zone increases conductivity of water from the wet zone into the fracture 108 and then to the well 100, which can result in excess water production or even kill the well. To avoid or reduce these risks, simultaneous fracturing treatments may be applied within the vertical well 100 at each of the wet zones and the target formation 102. A primary or acid fracturing treatment is applied to the target formation 102, and a secondary fracturing treatment is applied to each of the wet zones 104 and 106. In this example, because two wet zones are present (that is, first wet zone 104 and second wet zone 106), a separate, secondary fracturing treatment may be performed in each of the first wet zone 104 and second wet zone 106. The fracturing treatments applied to the wet zones 104 and 106 and the target zone 104 may be applied simultaneously. In other instances, a single wet zone may exist adjacent to the target reservoir, whether uphole or downhole of the target reservoir. The fracturing treatments may be applied simultaneously to the single wet zone and the target formation.

Although FIG. 1 shows an example in which a wet zone is disposed both downhole and uphole of the target formation 102, the scope of the disclosure is not so limited. Rather, the described systems, methods, and devices of the present disclosure are equally applicable to conditions in which a single wet zone, whether uphole or downhole of the target formation, exists. In such instances, in the context of a vertical well, where a single wet zone exists, an additional fracturing treatment applied to the single wet zone may be applied simultaneously with the acid fracturing treatment applied to the target formation.

The secondary fracturing operations performed in the wet zones operate to prevent the acid from the acid fracturing treatment applied to the target formation from reaching or infiltrating the wet zones and, thus, prevent formation of wormholes within the wet zones. The fluids used in fracturing treatments applied to the wet zones 104 and 106 include one or more sealing agent additives along with one or more neutralizing additives. Example sealing agent additives include resins and cement. For example, cements (such as Portland cement and aluminate cement), resins (such as epoxy resins and phenolic resins), rubber (such as natural rubber and ethylene-propylene rubber, latex, and silicone) may be used as sealing agent additives. Moreover, any material that is operable to plug porosity of formation rocks may be used as a sealing agent additive.

The simultaneous primary and secondary fracturing treatments are opposing and competing fracturing treatments and create an in-situ dynamic barrier at or near a boundary between the target formation and a wet zone. The one or more neutralizing additives neutralize acid from the acid fracturing treatment when the additives contact the acid. Example neutralizing additives include calcium carbonate, which may be in powder form, sodium hydroxide, soda ash, and sodium carbonate. Additionally, the secondary fracturing operation distributes the sealing agent additives, and the sealing agent additives seal porosity within the wet zone infiltrated by the associated fracture. Particularly, the sealing agent additives seal porosity along a periphery of the fracture formed by the secondary fracturing treatment as well as the secondary fracture faces in secondary fracture wings. In some implementations, the secondary fracturing treatment includes a base (alkali) or calcium carbonate powder carried by a carrier, such as a liner gel or cross-linked gel. The base or calcium carbonate powder is displaced by a sealing material, such as a resin flush, that may be added after the neutralizing agent. For example, cross-linked gels and liner gels are examples of carrier fluids used to carry neutralizing agents. In some instances, the sealing agent is added after the neutralizing agent has been added. The sealing agent displaces the neutralizing agent.

Figure 2:
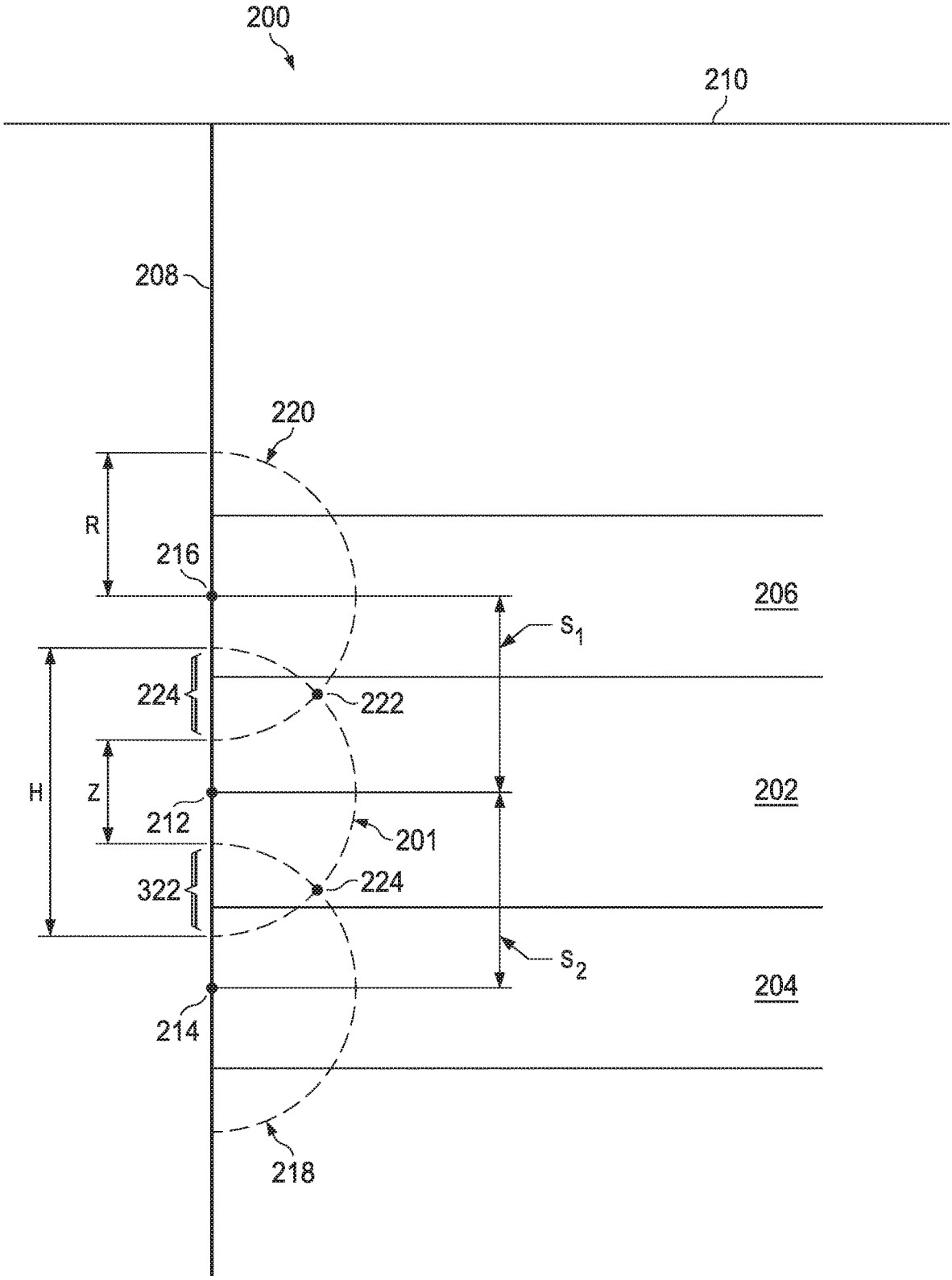
FIG. 2 is a fracture design for a carbonate formation having adjacent secondary formations that include wet zones, according to some implementations of the present disclosure.

FIG. 2 shows an example fracture design 200 for a carbonate formation have an adjacent wet zone and in the context of a vertical well. The fracture design 200 may be used to create in-situ dynamic barriers, allowing for production from the hydrocarbon-bearing carbonate formation that may otherwise be unrecoverable. The in-situ dynamic barriers enable acid fracturing of a target carbonate formation while, simultaneously, preventing or minimizing formation of wormholes in adjacent wet zones.

FIG. 2 shows a target formation 202 disposed between a first wet zone 204 and a second wet zone 206. The first and second wet zones 204 and 206 are located in secondary formations disposed adjacent to the target formation 202. The target formation 202 is an unconfined hydrocarbon-bearing carbonate formation. Thus, the target formation 202 lacks natural stress barriers between the target formation 202 and the adjacent wet zones 204 and 206. The first wet zone 204 is disposed adjacent to and downhole of the target formation 202, and the second wet zone 206 is disposed adjacent to and uphole of the target formation 202. Although wet zones disposed downhole and uphole of the target formation 202 are shown in the example implementation shown in FIG. 2, the described systems, methods, and devices are equally applicable to conditions in which a single wet zone, whether uphole or downhole of the hydrocarbon formation, exists.

A well 208 extends from a surface 210 of the earth through the target formation 202, first wet zone 204, and second wet zone 206. The wellbore may be cased or uncased. In the illustrated example implementation shown in FIG. 2, no significant stress barriers exist between the wet zones 204 or 206 and the target formation 202. In this context, "significant" means a barrier that would cause a fracture produced by a hydraulic fracturing treatment to remain within the target formation 202 and not extend or grow into the adjacent wet zones 204 or 206. Although FIG. 2 shows a wet zone uphole and downhole of the unconfined formation, the concepts described herein may be equally applicable to a single wet zone adjacent to an unconfined formation, either uphole or downhole of the unconfined formation.

The fracture design of FIG. 2 also shows a plurality of fractures 201, 218, and 220 formed in the target formation 202, the first wet zone 204, and the second wet zone 206, respectively. The fractures 201, 218, and 220 are illustrated as fracture wing, which is a visual representation of half of a fracture formed within a formation. Further, the fractures 201, 218, and 220 represent idealized fractures that would result from a fracturing operation unaffected by a fracturing operation in the other zones.

The idealized fracture 201 extends radially outward and into the first and second wet zones 204 and 206. Similarly, the fractures 218 and 220 are also shown extending into the target formation 202. However, in order to create the in-situ dynamic barriers, the fracturing operations used to form fractures 201, 218, and 220 are performed simultaneously. By performing the fracturing operations in this manner, production from the well 208 may be enhanced and the risk of excess water production up to a level that may eliminate any profitability of hydrocarbon production from a well may be avoided.

According to some implementations, the fracture design 200 is usable to form the in-situ dynamic barriers. FIG. 2 shows locations of a series of perforations (or fracture ports in the case of a cased or an uncased completion) formed in the well 208. A perforation is formed in the target formation 202 via the well 208 at a location 212; a perforation is formed in the first wet zone 204 via the well 208 at a location 214; and a perforation is also formed in the second wet zone 206 via the well 208 at a location 216. One or more of the perforations described earlier may be a series of perforations formed over a length of the target formation 202, wet zone 204, wet zone 206, or any combination of these. Thus, the perforations, as described herein, may be considered to be a zone of perforations at the locations 212, 214, and 216 (for example, centered on the locations 212, 214, and 216).

The locations 212, 214, and 216 of the perforations may be selected based on several factors. Example factors that may be used to select locations for perforations include the actual height fracture of a primary fracture, an amount by which the height of the fracture extends into the wet zones, and the actual heights of the secondary fractures. Also, an amount of overlap between the primary fracture and a secondary fracture may affect locations 212, 214, and 216 of the perforations. In some implementations, fracture heights of the fractures 201, 218, and 220 are simulated before applying the fracture treatment. A "data frac" treatment, described in more detail later, may be applied, and a fracture height may be determined in the primary target formation 202 with the use of temperature logging, for example. Locations 216 and 214 may be selected based on the simulation results to achieve desired fracture extension into the target formation 202 while preventing generation of wormholes in the secondary formations 204 and 206. In other words, the distances S1 and S2 can be adjusted based on the fracture simulations and the actual information available before and during fracture treatment. In an ideal situation, for example, where perfect radial fractures are predicted to form in each of different target formation 202 and wet zones 204 and 206, a spacing between the perforations at locations 212, 214, and 216 can be estimated. As explained earlier, factors including the actual fracture height of the fractures 201, 218, and 220 are used to determine the spacing S1 and S2. The heights of these fractures 201, 218, and 220 may be estimated based on simulation results and acquired data, such as well log data. In the example implementation shown in FIG. 2, the fractures 201, 218, and 220 are shown as being perfect radial fractures formed in the target formation 202, the first wet zone 204, and the second wet zone 206, respectively. Further, in this example implementation and for the purposes of explanation, the fractures 201, 218, and 220 are identical in size.

While perfect radial fractures of identical size are used as an example in describing the features of the present disclosure, imperfect radial fractures, fractures of different sizes and shapes, or other types of fractures generally are within the scope of this disclosure. A size and shape of a fracture may be determined by gathering information, such as information about the formations. For example, a "data frac" may be performed in which a fracture treatment, without proppant, is applied to a formation to assess formation properties, such as fracture breakdown pressure, fracture extension pressure, fluid loss coefficient, fracture fluid efficiency, and fracture closure pressure. This information along with well log data may be used to predict a fracture height within the formation and a fracture gradient within the formation and to verify the presence of any stress barriers. Further, the design of the locations of the perforations may be altered accordingly based on the sizes and shapes of the fractures that may be predicted. The perforation and fracturing treatments may be modified accordingly in order to accommodate such fracture types.

Returning again to the example fracture design 200 shown in FIG. 2, separation S1 is a mid-perforation separation distance between the perforation made into the target formation 202 at location 212 and the perforation made into the first wet zone 204 at location 214. Similarly, separation S2 is a mid-perforation separation distance between the perforation made into the target formation 202 at location 212 and the perforation made into the second wet zone 206 at location 216. In this instance, the separations S1 and S2 are identical. For ideal radial fractures, the separations S1 and S2 are determinable using the following set of equations:

$$S1=R+(Z/2);$$

$$S1=S2;$$

$$S1\leq 2R; \text{ and}$$

$$H=2R,$$

where R is a fracture half-length (that is, half of the entire length of the fully developed fracture), H is the fracture height; Z is a perforated interval length in the target formation 202 (that is, a length along the target formation 202 in which the perforations are formed); and S1 and S2 are the mid-perforation spacings between a center of the perforated interval length, Z, and center of a perforated zone formed within each of the wet zones 204 and 206, respectively.

For non-ideal fractures (that is, fractures that are not ideal radial fractures), the separations S1 and S2 are determinable using the following set of equations:

$$S1=(H/2)+(Z/2);$$

$$S1=S2; \text{ and}$$

$$S1\leq H;$$

$$R>(H/2),$$

where R is a fracture half-length (that is, half of the entire length of the fully developed fracture), H is the fracture height; Z is a perforated interval length in the target formation 202 (that is, a length along the target formation 202 in which the perforations are formed); and S1 and S2 are the mid-perforation spacings between a center of the perforated interval length, Z, and center of a perforated zone formed within each of the wet zones 204 and 206, respectively.

In some implementations, the fracture half-length is simulated based on the properties of the target formation 202, such as fracture breakdown pressure, fracture extension pressure, fluid loss coefficient, fracture fluid efficiency, and fracture closure pressure, and the treatment size. In some implementations, the perforated interval length, Z, is determined based on both fracture treatment requirements, such as formation break down pressure, fracture geometry, and a hydrocarbon production requirement that does not restrict well productivity.

A fracture is fully developed when the fracture is formed to a maximum desired size. As indicated earlier, in this example implementation, S1 is made to equal S2. These distances may be the same where circumstances merit such uniformity. However, the distances S1 and S2 may be different in other instances where, for example, the pay zone within the target formation 202 is not symmetrically disposed relative to the wet zones 204, 206 or the formation characteristics of the wet zones 204, 206 are dissimilar. Other considerations may also lead to instances where S1 is not equal to S2. Thus, in some instances, S1 may be the same or essentially the same as S2 and, in other instances, S1 may be different from S2.

Additionally, the sizes of S1 and S2 are chosen so that outer portions of the fracture 201 interfere with outer portions of the fractures 218 and 220. These areas of interference, or interference zones 222 and 224, are shown in FIG. 2. The interference zones 222 and 224 are a graphical illustration of an area over which the adjacent fractures oppose or compete with each other during the formation of the fractures. Therefore, generally, S1 and S2 are chosen according to the following relationship:

$$R+Z/2 \leq S1, S2 \leq 2R$$

S1 and S2 may be selected such that either S1 or S2 is not the same as twice the length of R. Where S1 or S2 is equal to twice the distance of R, no interference between the fractures occurs.

The perforations formed at locations 214 and 216 are used to apply secondary fracturing operations to the first and second wet zones 204 and 206. The secondary fracturing operations are applied at the same time an acid fracturing treatment is applied to the target formation 202 via the perforated zone located at location 212. As shown in FIG. 2, the interference zones 222 and 224 represent areas over which the fracturing treatment applied to the target formation 202 opposes or competes with fracture treatment applied to the wet zones 204 and 206. This opposition or interference results in the formation of in-situ dynamic barriers between the competing fracturing treatments. These in-situ dynamic barriers prevent the acid fracturing treatment applied to the target formation 202 from infiltrating the adjacent wet zones 204 and 206.

For example, as the fractures 201 and 218 grow, these fractures 201 and 218 interfere with each other. Interference between these growing fractures 201 and 218 results in the formation of an in-situ dynamic barrier at an interface between the competing fractures 201 and 218. As the fractures 201 and 218 begin to interfere with each other, the acid neutralizing additives in the fracturing fluid used to fracture wet zone 204 neutralizes the acid contained in the fluid used to fracture the target formation 202. As a result, infiltration of the acid fracturing fluid into the wet zone 204 is prevented or reduced. Consequently, wormholes are prevented from being formed beyond the in-situ dynamic barrier. Thus, wormholes are prevented from being formed in the wet zone 204. This interaction similarly applies to the interference that occurs between the formation of fracture 201 and formation of fracture 220 during the respective simultaneous fracturing treatments.

Additionally, the sealing agent additives in the fluid used to fracture the first wet zone 204 forms a seal in the rock along the in-situ dynamic barrier. This seal prevents or reduces water movement from the wet zone 204 into the target formation 202, such as water that may otherwise have moved into the target formation 202 via fracture 201. Consequently, excess water production from the well 208 is also reduced or prevented.

Figure 3:
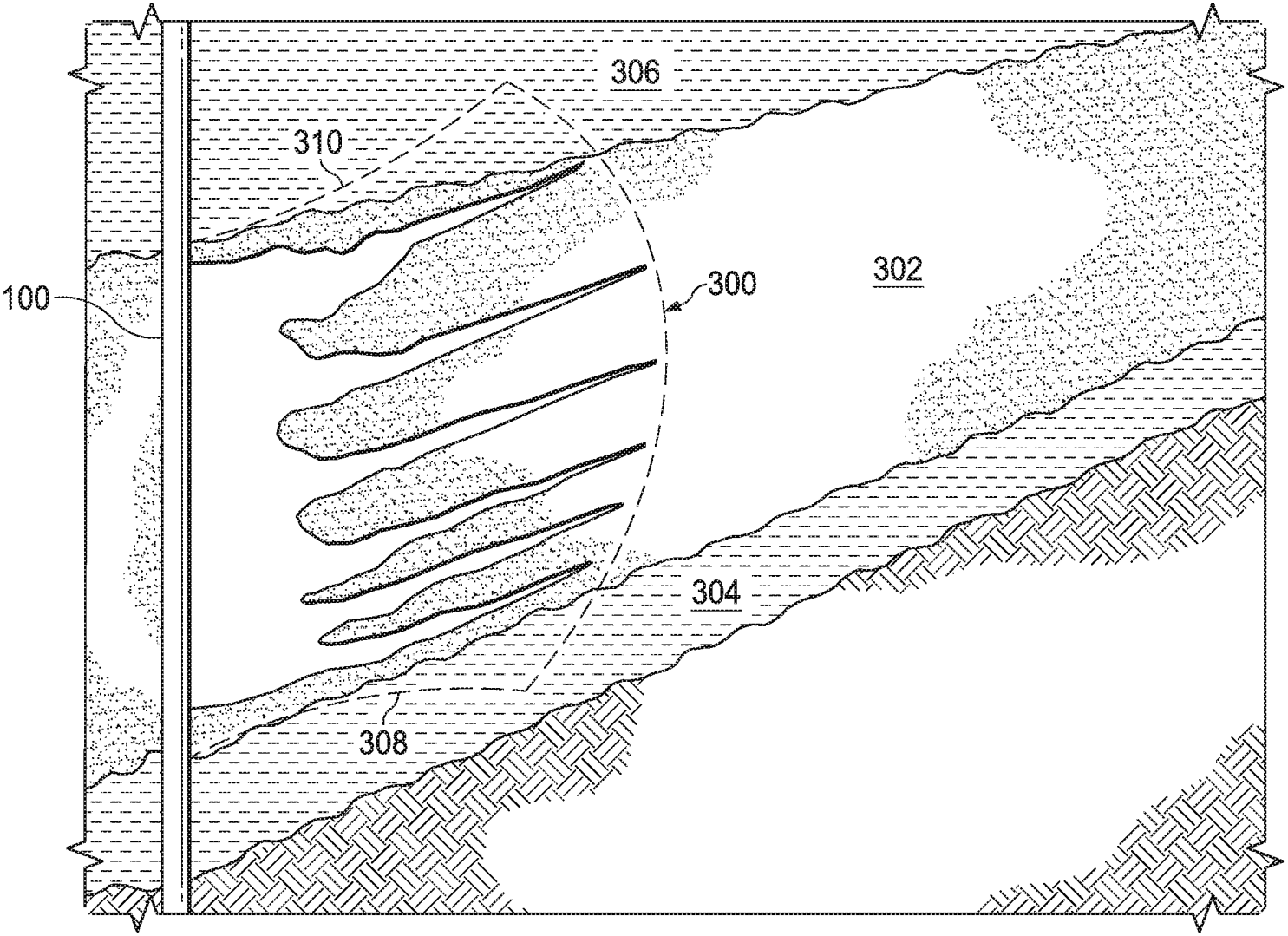
FIG. 3 is a view of a formation in which a fracture has truncated ends as a result of in-situ dynamic barriers created during opposing and competing simultaneous fracturing treatments, according to some implementations of the present disclosure.

FIG. 3 shows a resulting fracture 300 formed in a target formation 302 as a result of simultaneous fracturing treatments described earlier. The formation 302 is flanked by adjacent secondary formations containing wet zones 304 and 306, similar to those described earlier. As shown in FIG. 3, the fracture 300 has a truncated shape at ends 308 and 310. The truncated shape of the ends 308 and 310 follows the in-situ dynamic barriers that were created as a result of the opposing and competing simultaneous fracturing treatments.

Figure 4:
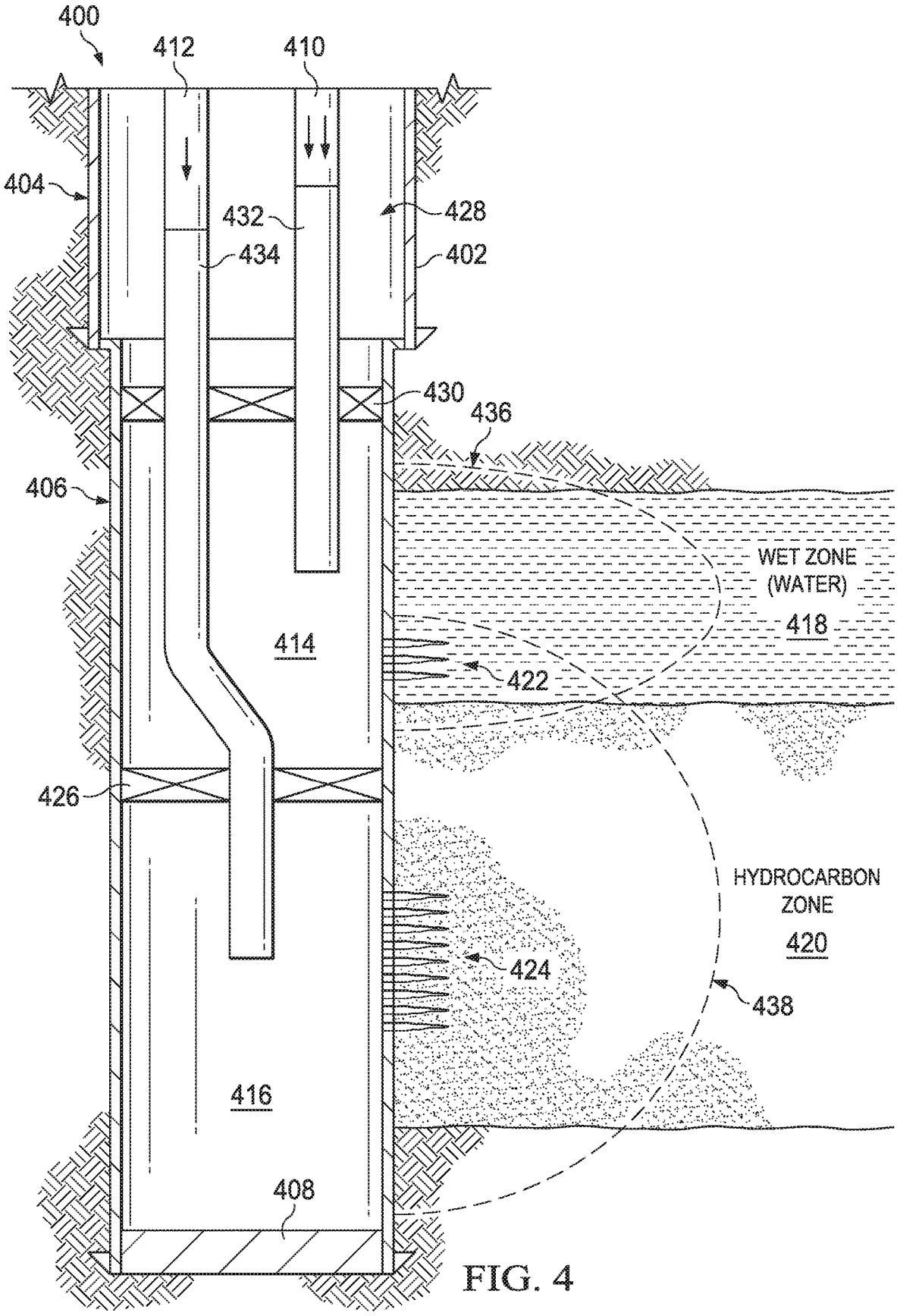
FIG. 4 is an example dual string fracturing completion that may be used to perform two simultaneous fracturing treatments of a target formation and a wet zone contained in an adjacent secondary formation and create an in-situ dynamic barrier between the competing fracturing treatments, according to some implementations of the present disclosure.
Figure 5:
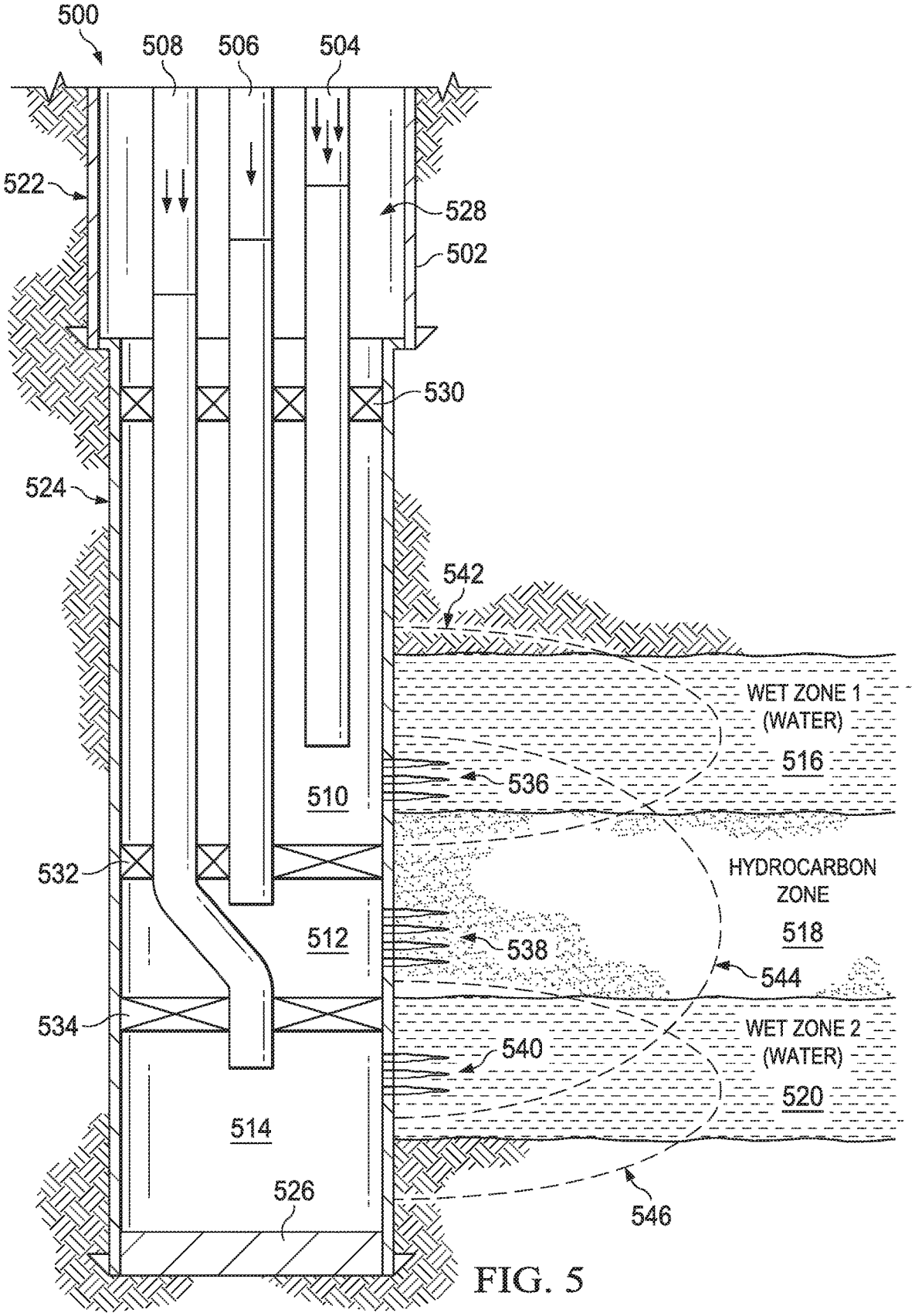
FIG. 5 is an example triple string fracturing completion that may be used to perform three simultaneous fracturing treatments of a target formation and wet zones contained in adjacent secondary formations and create in-situ dynamic barriers between the competing fracturing treatments, according to some implementations of the present disclosure.

A dual string fracturing completion may be used to simultaneously apply two separate fracturing treatments and form a single in-situ dynamic barrier. A triple string fracturing completion may be used to perform three simultaneous fracturing treatments and form two in-situ dynamic barriers. Selection of a dual string completion or triple string completion may be determined by the number of wet zones present near the target formation. If a single water-bearing formation or zone is present uphole or downhole of the target hydrocarbon-bearing formation, then a dual string fracturing completion is needed. An example dual string fracturing completion is shown in FIG. 4. If a water-bearing formation or zone is present above and below the target formation, then a triple fracture string completion is needed. An example triple string fracturing completion is shown in FIG. 5.

FIG. 4 is a schematic view of an example dual string fracturing completion 400 that may be used to perform two simultaneous fracturing treatments of a target formation and an adjacent wet zone and create an in-situ dynamic barrier between the competing fracturing treatments. The adjacent wet zone may be, or form part of, an adjacent secondary formation.

The dual string fracturing completion 400 is disposed in a wellbore 402. The example wellbore 402 includes a casing 404 and a liner 406 extending from the casing 404 to a plug 408. The dual string fracturing completion 400 includes a first fracturing string 410 and a second fracturing string 412. The first fracturing string 410 terminates in a first zone 414, and the second fracturing string 412 terminates in a second zone 416. The first zone 414 is aligned with a wet zone 418, and the second zone 416 is aligned with a target formation 420. A first set of perforations 422 is formed in the wet zone 418 within the first zone 414, and a second set of perforations 424 is formed in the target formation 420 within the second zone 416.

The first zone 414 and the second zone 416 are separated by an isolation packer 426. The first zone 414 is isolated from an uphole portion 428 of the wellbore 402 by a dual string packer 430. The first fracturing string 410 defines a passageway 432 that conducts a fracturing fluid to the first zone 414. The second fracturing string 412 defines a passageway 434 that conducts a fracturing fluid to the second zone 416. For the illustrated example, the second fracturing string 412 also functions to deliver fluids, such as hydrocarbons, produced from the target formation 420 to the surface.

Although the example illustrated in FIG. 4 has a wet zone 418 disposed uphole of a target formation 420 containing hydrocarbons, the scope of the disclosure also covers a configuration where a wet zone is located downhole from a target formation. In such an instance, a first fracturing string (such as the first fracturing string 410) is aligned with the target formation, and a second fracturing string (such as the second fracturing string 412) is aligned with the wet zone.

Because the first zone 414 is isolated from both the uphole portion 428 and the second zone 416 and because the second zone 416 is isolated from the first zone 414 and any remainder of the wellbore 402 downhole of the second zone 416 by the plug 408, the first zone 414 and the second zone 416 can be fractured independently from each other and the rest of the wellbore 402 by the respective first fracturing string 410 and the second fracturing string 412. As shown, a first fracture 436 extending into the wet zone 418 from the first zone 414 is created as a result of a fracturing operation performed using the first fracturing string 410. A second fracture 438 extending into the target formation 420 from the second zone 416 results from a fracturing operation performed using the second fracturing string 412.

In some implementations, the dual string fracturing completion 400 is operable to withstand pressures required to fracture and extend a fracture in the wet zone 418 and the target formation 420. For example, typical treating pressures are within a range of 9,000 pounds per square inch (psi) to 14,500 psi. In some implementations, the dual fracturing string completion 400 is operable to withstand downhole pressures within a range of 13,000 psi to 21,000 psi. In some cases, a treating pressure of 12,000 psi and a downhole pressure of 16,000 are common.

In addition to treatment pressures and downhole pressures, other considerations may be relevant with respect to the performance of the dual string fracturing completion 400. For example, other than a maximum allowable treating pressure and downhole pressure, the types of fluids to be conducted by the fracturing strings 410 and 412 are also important. Particularly, a cross-sectional size of the fracturing strings 410 and 412 is an important factor for acid fracturing operations due to fluid friction exerted by the acid fracturing fluid. Generally, smaller tubing sizes limit pumping rates of the fracturing fluid due to high fluid friction pressures.

Although the completion 400 shows a dual string that may be used to fracture two formations or zones simultaneously, a triple string completion may be used to simultaneously fracture three formations or zones, such as a carbonate formation lacking a natural stress barrier and adjacent wet zones. A first wet zone is located uphole of a target formation, and a second wet zone is located downhole of the target formation. The adjacent wet zones may be, or form part of, adjacent secondary formations. An example triple string completion 500 is shown in FIG. 5.

The triple string completion 500 is disposed in a wellbore 502 and includes a first fracturing string 504, a second fracturing string 506, and a third fracturing string 508. The first fracturing string 504 extends to a first zone 510; the second fracturing string 506 extends to a second zone 512; and the third fracturing string 508 extends to a third zone 514. The first zone 510 is aligned with a first wet zone 516. The second zone 512 is aligned with a target formation 518. The target formation 518 contains hydrocarbons, such as oil, gas, or both oil and gas. The third zone 514 is aligned with a second wet zone 520. The first fracturing string 504 defines a first passageway 505; the second fracturing string 506 defines a second passageway 507; and the third fracturing string 508 defines a third passageway 509. Each of the passageways 505, 507, and 509 are operable to conduct fracturing treatments to the respective zones 510, 512, and 514. In addition to delivering a fracturing treatment, the second fracturing string 506 also functions to deliver fluids, such as hydrocarbons, produced from the target formation 518 to the surface.

The wellbore 502 includes a casing 522, and a liner 524 extending downhole from the casing 522 to a plug 526. The first zone 510 is isolated from an uphole portion 528 of the wellbore 502 by a multi-string isolation packer 530 and from the second zone 512 by a multi-string isolation packer 532. The second zone 512 is isolated from the third zone 514 by an isolation packer 534 and from any portion of the wellbore 502 extending downhole by the plug 526. As a result of the isolation packers 530, 532, 534 and the plug 526, each zone 510, 512, and 514 may be fractured independently of the other zones by the respective fracturing strings 504, 506, and 508.

A first set of perforations 536 is formed in the first wet zone 516 within the first zone 510; a second set of perforations 538 is formed in the target formation 518 within the second zone 512; and a third set of perforations 540 is formed in the second wet zone 520 within the third zone 514. In some implementations, one or more of the first set of perforations 536, the second set of perforations 538, and the third set of perforations 540 may be in the form of fracture ports (also referred to as "frac ports"). As shown, a first fracture 542 extending into the first wet zone 516 from the first zone 510 is created as a result of a fracturing operation performed using the first fracturing string 504. A second fracture 544 extending into the target formation 518 from the second zone 512 results from a fracturing operation performed using the second fracturing string 506. A third fracture 546 extending into the second wet zone 520 from the third zone 514 results from a fracturing operation performed using the third fracturing string 508.

Similar to the dual string fracturing completion 400, the triple string fracturing completion 500 is operable to withstand pressures required to fracture and extend a fracture in the first wet zone 516, the target formation 518, and the second wet zone 520. For example, typical treating pressures are within a range of 9,000 pounds per square inch (psi) to 14,500 psi. In some implementations, the triple fracturing string completion 500 is operable to withstand downhole pressures within a range of 13,000 psi to 21,000 psi. In some cases, a treating pressure of 12,000 psi and a downhole pressure of 16,000 are common.

In addition to treatment pressures and downhole pressures, other considerations may be relevant with respect to the performance of the triple string fracturing completion 500. For example, other than a maximum allowable treating pressure and downhole pressure, the types of fluids to be conducted by the fracturing strings 504, 506, and 508 are also important. Particularly, a cross-sectional size of the fracturing strings 504, 506, and 508 is an important factor for acid fracturing operations due to fluid friction exerted by the acid fracturing fluid. Generally, smaller tubing sizes limit pumping rates of the fracturing fluid due to high fluid friction pressures. Therefore, in some instances, in order to maintain a needed cross-sectional size of the fracturing strings 504, 506, and 508, a cross-sectional size of the wellbore 502 may be enlarged over at least a portion of a length of the wellbore 502 in order to accommodate a wider completion.

The simultaneous fracturing of adjacent formations or zones is not limited to vertical wells. For example, the implementations described earlier may be applicable to slant wells. Moreover, the methods, systems, and devices described herein also may be applied to horizontal wells.

Figure 6A:
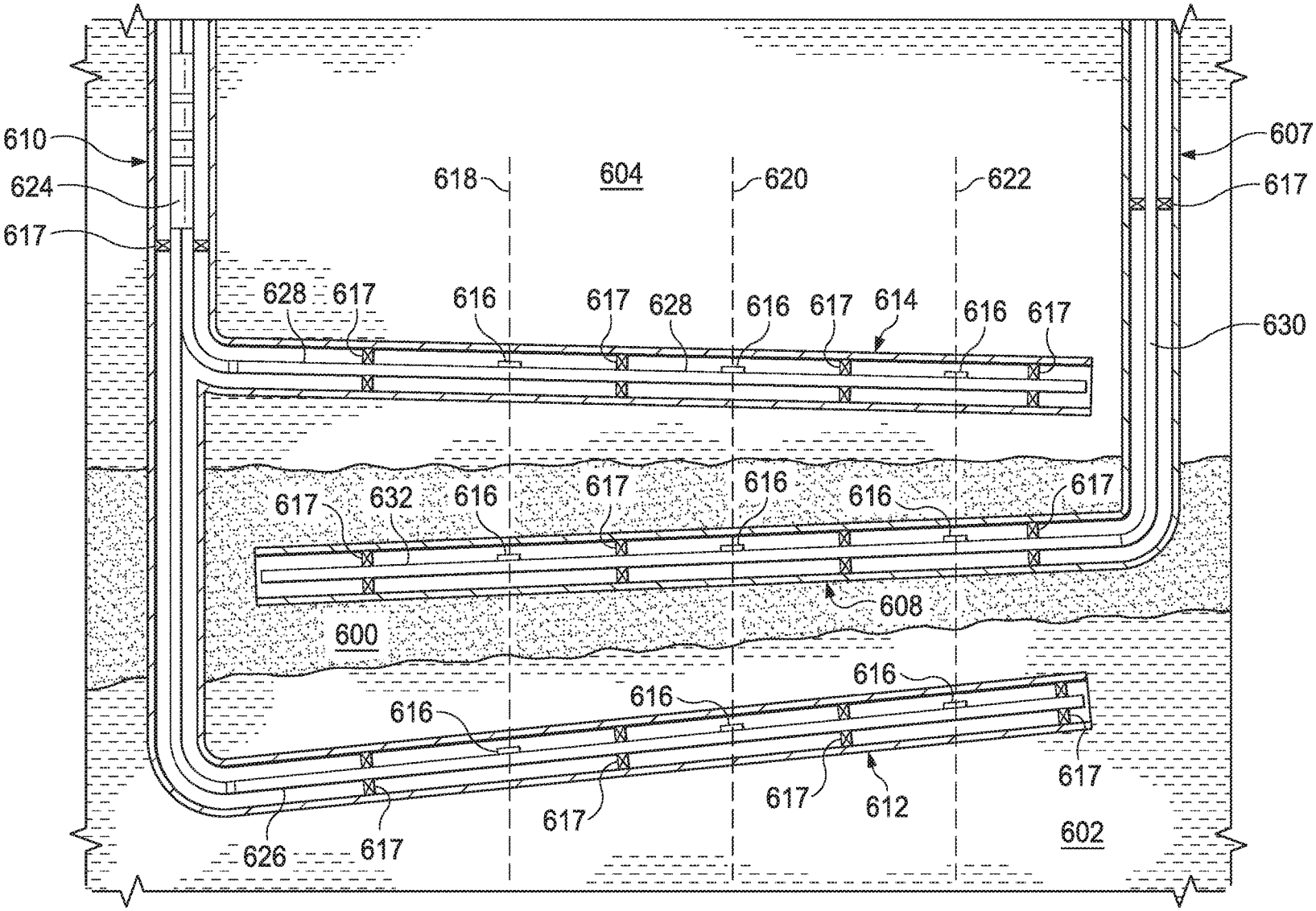
FIG. 6A is a cross-sectional view showing a target formation and adjacent secondary formations with a lateral portion of a well extending through each formation, according to some implementations of the present disclosure.

FIG. 6A is a cross-sectional view showing a target formation 600 and adjacent secondary formations 602 and 604. The target formation 600 is a hydrocarbon-bearing carbonate formation. One or both of the secondary formations 602 and 604 may be a wet zone. In the illustrated example, both secondary formations 602 and 604 are wet zones. In other implementations, one of the secondary formations 602 and 604 may not be a wet zone. The secondary formation 602 is disposed downhole of the target formation and the secondary formation 604 is disposed uphole of the target formation 600. A primary well 607 is drilled as a single lateral horizontal well. The primary well 607 extends to the target formation 600 and includes a primary lateral portion 608 that extends through the target formation 600. The primary lateral portion 608 may be formed in a production or pay zone of the target formation 600. A secondary well 610 is drilled as a dual lateral horizontal well. As such, the secondary well 610 includes a first secondary lateral portion 612 that extends through the secondary formation 602 and a second secondary lateral portion 614 that extends through the secondary formation 604. Control of vertical placement of the first secondary lateral portion 612 and the second secondary lateral portion 614 relative to each other and relative to the primary lateral portion 608 is needed so that fracture treatments in one lateral portion interferes with a fracture treatment in an adjacent lateral portion at a desired location within the earth.

Figure 6B:
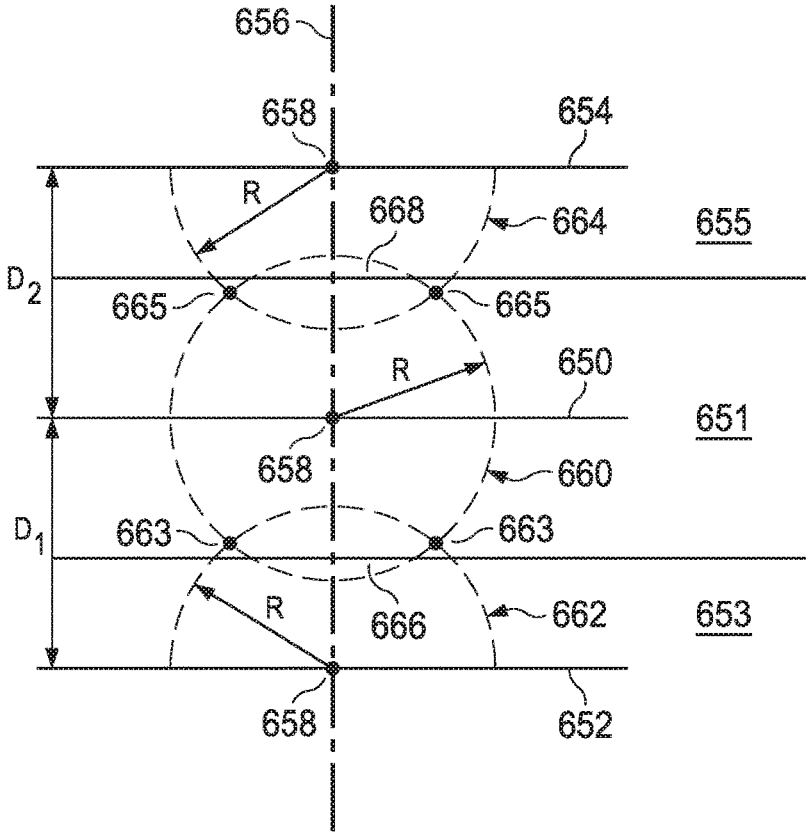
FIG. 6B is a detailed view illustrating vertical spacing between adjacent lateral portions, according to some implementations of the present disclosure.

Vertical spacing between a primary lateral portion and secondary lateral portions is determined in a manner similar to that explained earlier in the context of a vertical well. FIG. 6B is a schematic view showing a primary lateral portion 650, secondary lateral portions 652 and 654, and a fracture plane 656 extending across injection points 658. The primary lateral portion 650 extends through a target formation 651; the first secondary lateral portion 652 extends through a first secondary formation 653; and the second secondary lateral portion 654 extends through a second secondary formation 655. The injection points 658 are laterally aligned. Idealized radial fractures 660, 662, and 664 extend outwardly from the injection points 658 at each of the lateral portion 650, 652, and 654, respectively. Idealized radial fractures 662 and 664 are partially illustrated in FIG. 6B. It will be appreciated that the radial fractures 662 and 664 extend below the first secondary lateral portion 652 and above the second secondary lateral portion 654, respectively, in the context of the representation shown in FIG. 6B. The fractures 660, 662, and 664 are formed simultaneously such that, as the fractures grow, the fracture 660 interferes with the adjacent fracture 662 at interference zone 663 and with the adjacent fracture 664 at interference zone 665 to form in-situ dynamic barriers. In the illustrated example, the interference zones 663 and 665 are located within the target formation 651. In an ideal situation, for example, where perfect radial fractures are predicted to form in each of the associated formations, a spacing D1 and D2 between the primary lateral 650 and the secondary laterals 652 and 654, respectively, can be estimated.

While perfect radial fractures of identical size are used as an example in describing the features of the present disclosure, imperfect radial fractures, fractures of different sizes and shapes, or other types of fractures generally are within the scope of this disclosure. A size and shape of a fracture may be determined by gathering information, such as information about the formations. A data frac, as explained earlier, may be performed to determine formation properties such as fracture breakdown pressure, fracture extension pressure, fluid loss coefficient, fracture fluid efficiency, and fracture closure pressure. This information may be used to predict a fracture height within the formation and a fracture gradient within the formation and to verify the presence of any stress barriers. Further, the locations or orientations or both of the primary lateral portion 650 and secondary lateral portions 652 and 654 may be altered accordingly, based on the sizes and shapes of the fractures that may be predicted. The positioning of the lateral portions and the fracturing treatments may be modified accordingly in order to accommodate formation properties and characteristics as well as predicted fracture types.

As shown in FIG. 6B, a separation distance D1 defines a distance between the primary lateral portion 650 and the secondary lateral portion 652, and a separation distance D2 defines a distance between primary lateral portion 650 and the secondary lateral portion 654. In this instance, the separation distances D1 and D2 are identical. However, the separation distances D1 and D2 may be different. The separation distances may be altered depending on, for example, formation characteristics, fracture growth within the formation, and a maximum size of a fracture that may be successfully produced. The separations D1 and S2 are determinable using the following set of equations:

$$D1=D2;$$

$$2R>D1>R;$$

where R is a fracture half-length of a fully-developed fracture and D1 and D2 are the separation distances between the lateral portions. A fracture is fully developed when the fracture is formed to a maximum desired size. As indicated earlier, in this example implementation, D1 is made to equal D2. These separation distances may be the same where circumstances merit such uniformity. However, the separation distances D1 and D2 may be different in other instances where, for example, the pay zone within the target formation is not symmetrically disposed relative to the secondary formations or where the formation characteristics of the secondary formations are dissimilar. Other considerations may also lead to instances where D1 is not equal to D2. Thus, in some instances, D1 may be the same or essentially the same as D2 and, in other instances, D1 may be different from D2

Additionally, the sizes of D1 and D2 are chosen so that outer portions of the fracture 660 interfere with outer portions of the fractures 662 and 664. These areas of interference, or interference zones 666 and 668, are shown in FIG. 6B. The interference zones 666 and 668 are a graphical illustration of an area over which the adjacent fractures oppose or compete with each other during the formation of the fractures. Therefore, generally, D1 and D2 are chosen according to the following relationship:

$$R<D1,D2<2R$$

D1 and D2 may be selected such that either D1 or D2 is not the same as twice the length of R. Where D1 or D2 is equal to twice the distance of R, no interference between the fractures occurs.

Returning to FIG. 6A, lateral control of injection points 616 (that is, locations along the lateral portions where fracturing fluids are injected into the surrounding formation) along the lateral portions is needed in order to align the injection points 616 of the primary lateral portion 608 with injection points 616 of the secondary lateral portions 612 and 614. Thus, the injection points 616 in each of the primary lateral portion 608 and secondary lateral portion 612 and 614 align so that a fracture plane across all three lateral potions is the same. In the example illustrated in FIG. 6A, each lateral includes three injection points 616, and each of those injection points 616 is aligned with the injection points 616 in an adjacent lateral portion. The injection points 616 are isolated from adjacent injection points 616 by an isolation packer 617. However, other types of isolation devices may be used, such as isolation plugs, a fracture ball and seat, closable fracture ports, sensor-operated fracture ports, or a combination of these isolation devices. Consequently, the aligned injection points 616 across the lateral portions define three fracture planes 618, 620, and 622. Therefore, not only are the lateral portions 608, 612, and 614 aligned vertically, the injection points 616 in adjacent lateral portions are also aligned.

Figure 6C:
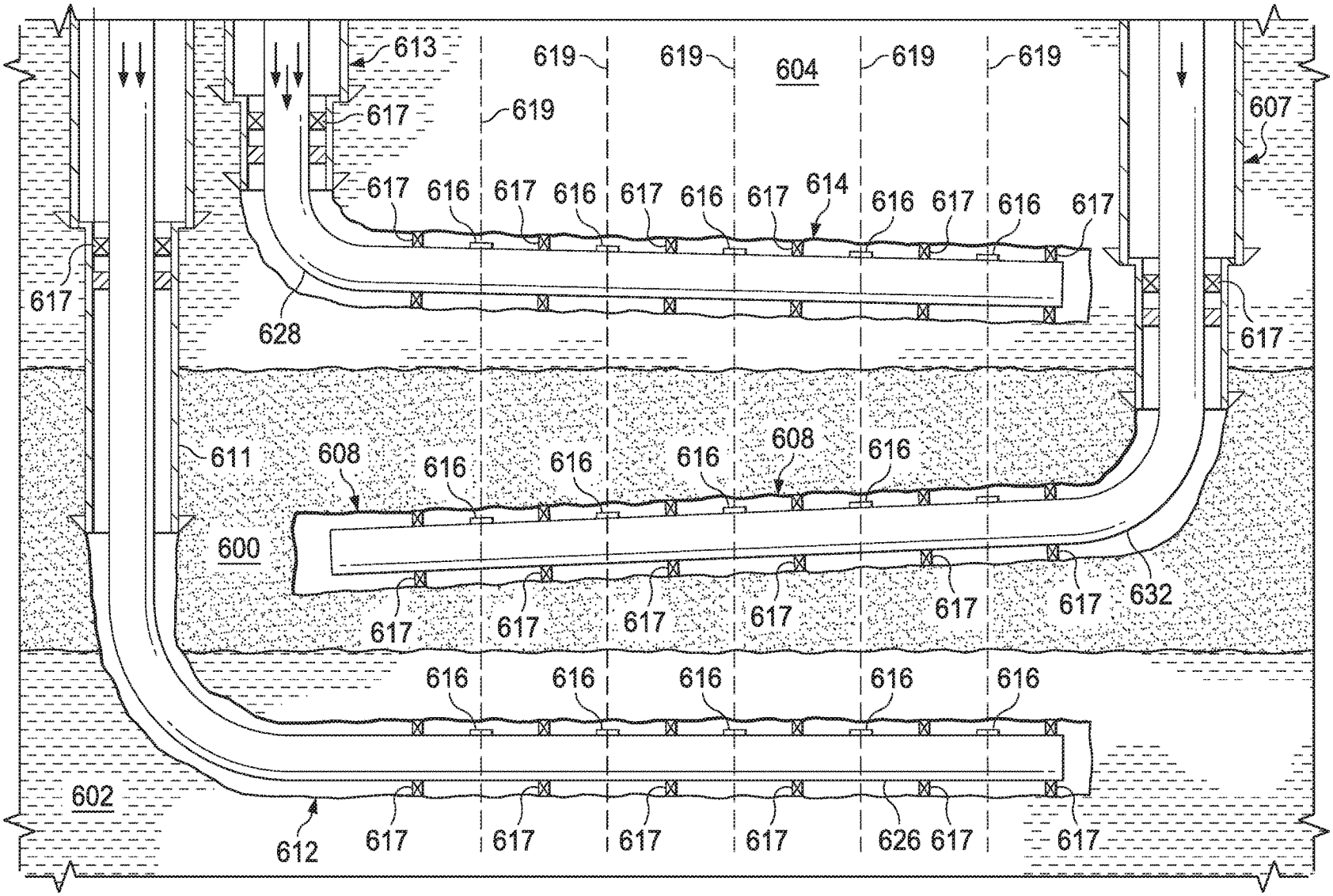
FIG. 6C is a cross-sectional view showing well extending into a target formation and separate lateral wells extending into adjacent secondary formations, according to some implementations of the present disclosure.

Although the example illustrated in FIG. 6A includes three injection points 616 aligned along the fracture planes 618, 220, and 622, the scope of the disclosure is not so limited. Rather, in other implementations, more than three fracture planes or fewer than three fracture planes may be defined. For example, as shown in FIG. 6C, five fracture planes 619 are present. The number of fracture planes may vary based on a length of the lateral portions and the stimulation needed to effectuate fracturing of the formations.

A dual string completion 624 may installed into the secondary well 610, with one string extending into each of the secondary lateral portions 612 and 614. For example, a first completion string 626 extends through the first secondary lateral portion 612 and a second completion string 628 extends through the second secondary lateral portion 614. A single string completion 630 is installed in the primary well 607 and includes a completion string 632 that extends through the primary lateral portion 608. The injection points 616 may be one or more slots or apertures formed in the completions extending through the lateral portions 608, 612, and 614. Further, in some implementations, the wells 607 and 610 may be cased. In other implementations, one or both of the wells may be uncased.

In other implementations, as shown in FIG. 6C, separate lateral wells 611 and 613 are formed, as opposed to a single secondary well 610 having lateral portions 612 and 614. The first lateral well 611 extends into the secondary formation 602, and the second lateral well 613 extends into the secondary formation 604. The primary well 607 extends into the target formation 600. The first completion string 626 extends through the first secondary lateral portion 612 of the first lateral well 611; the second completion string 628 extends through the second secondary lateral portion 614; and the completion string 632 extends through the primary lateral portion 608.

A variety of methods may be used to align the injection points 616 across the lateral portions 608, 612, and 614 so as to establish the fracture planes 618, 620, and 622. For example, in some instances, thermal or acoustic methods may be used to identify the injection points in one or more of the lateral portions 608, 612, and 614.

When using a thermal method, the target formation 600 is perforated. In the context of the example shown in FIG. 6A, the target formation 600 may be perforated at one or more locations adjacent to the injection points 616. For example, although three injection points 616 are present along the primary lateral portion 608, one or more perforations may be formed at, or adjacent to, each of the injection points 616. For example, in some instances, a perforation interval may be associated with each of the injection points 616 present along the primary lateral portion 608. A fracturing fluid is then injected into the target formation 600 at each of the injection points 616. In some implementations, the fluid may be cross-linked pad. A cross-linked pad includes fracturing fluids, such as gels, that include a cross-linker. In addition to guar, other types of fluids that may be used to form a cross-linked pad include hydroxypropyl guar (HPG), carboxymethyl HPG (CMHPG) and viscoelastic surfactants. Example cross-linkers include borate, zirconate, and titante cross-linker and a mixture of those. For example, a Guar gelled fluid may include Borate to form a cross-linked pad. The addition of a cross-linker generally raises viscosity of the fluid. Water-based fracturing fluids may also be used to identify injection points in adjacent lateral portions. For example guar-based fluids and guar derivatives may be used.

The injected fluid may be injected at increased temperature. In other implementations, the injected fluid may have a lower temperature than the target formation 600 or the secondary formations 602 and 604. In still other implementations, the fluid that produces an exothermic reaction may also be used. The exothermic reaction generates heat that is detectable as described earlier.

A thermal sensor that is run into or otherwise placed in one of the first secondary lateral portions 612 and the second secondary lateral portions 614 is used to detect heating or cooling applied to the target formation 600 by the injected fluid. For the example described later, a thermal sensor is inserted into the first secondary lateral portion 612 initially. However, the thermal sensor could be initially installed in the second secondary lateral portion 614. The thermal sensor detects a temperature change in the formation caused by, for example, a fluid injected into the formation, as discussed in more detail later. The temperature change may be an increase in temperature or a decrease in temperature. In some implementations, a coiled tubing that includes a distributed temperature survey system (DTS) may be introduced into the first secondary lateral portion 612 to detect a change in temperature within the secondary formation 602 caused by the injected fluid.

The volume of fluid injected by the completion string 632 at the injection point 616 should be sufficient to extend a length of the generated fracture to the secondary lateral portion 612. In this example, the thermal sensor detects a drop in temperature when the injected fluid reaches the secondary lateral portion 612. A lateral location along the secondary lateral portion 612, where this temperature decrease is detected, aligns with a lateral location of the injection point 616 associated with the primary lateral portion 608. As a result, a lateral alignment location along the secondary lateral portions 612 and 614 may be detected for each corresponding injection point 616 associated with the primary lateral portion 608. A similar fluid injection may be made at each injection point 616 along the primary lateral portion 608 and the corresponding location along the secondary lateral portion 612 may be detected. The thermal sensor, such as a DTS, for example, may be inserted into the second secondary lateral portion 614 and the process repeated at the other injection points 616 along the primary lateral portion 608. In some instances, once a location of an injection point 616 in the secondary lateral portion 612 is determined, the coiled tubing carrying the thermal sensor, such as the DTS, may also be used to perforate the secondary lateral portion 612, including any associated casing, at the injection point 616. For example, the coiled tubing may perforate one or more locations of or an interval along the secondary lateral portion 612 corresponding to the injection point 616 in the primary lateral portion 608 with a hydrajet perforating technique. In some implementations, fluid may be injected at each of the injection points 616 of the primary lateral portion 608 simultaneously. Similarly, the thermal sensor or a plurality of thermal sensors located in the secondary lateral portion 612 may detect all of the injection point during the single fluid injection event.

A thermal sensor is then inserted in the second secondary lateral portion 614. For example, a DTS included on a coiled tubing may be run into the secondary lateral portion 614. The fluid injections are then repeated at each injection point 616 of the primary lateral portion 608, and the corresponding injection points 616 along the secondary lateral portion 614 are located in the manner described earlier. The secondary formation 604, including any associated casing, may then be perforated in a manner similar to that described earlier. For example, the coiled tubing that includes the DTS may be used to perforate the secondary formation 604 such as using a hydrajet perforating technique.

In some instances, separate thermal sensors may be inserted in each of the secondary lateral portions 612 and 614 and the locations along each may be simultaneously detected as fluid is injected and a fracture is made at each injection point of the primary lateral portion 608, as described earlier. Thus, the corresponding injection points 616 in each of the secondary lateral portions 612 and 614 may be detected simultaneously and the fracture planes 618, 620, and 622 determined more quickly and at a lower cost than sensing thermal changes in each secondary lateral portion separately. Once the injection points 616 in the secondary lateral portion 612 and 614 are determined, these locations of the secondary formations 602 and 604 may be perforated in any desired order.

By this method, locations of the injection points 616 in each of the secondary lateral portion 612 and 614 that align with the injection points 616 in the primary lateral portion 608 are identified and the fracture planes 618, 620, and 622 determined. After all injection points 616 along the secondary lateral portion 612 and 614 have been identified and the secondary formations 602 and 604 perforated accordingly, simultaneous fracturing treatments that form in-situ dynamic barriers may then be performed. Fracture simulations and formation data, such as formation data collected from offset wells, may be used in combination with the temperature measurements described previously or in combination with the injection point detection methods described later in order to identify fracture plane locations. Costs may be reduced by replacing perforations formed in secondary lateral portions with ball-activated fracturing ports or sensor-operated fracturing ports positioned at locations corresponding to the fracture planes.

In other implementations, a distributed temperature survey may also be used to monitor temperature changes that result from hydraulic fracturing. The distributed temperature survey utilizes a fiber optics cable located inside coiled tubing. The fiber optics cable is operable to detect changes in temperature along a length of the fiber optics cable. In still other implementations, radioactive and nonradioactive proppant tracers may be used to detect the fracture height growth. These proppant tracers are detectable at adjacent lateral portions to identify a location where an injection point should be located to form a fracture plane. In still other implementations, micro-seismic monitoring may be used to align injection points along a fracture plane by detecting a signal generated as a result of cracking of formation rock. In other implementations, an acoustic method utilizes geophones that are used to locate injection points along a fracture plane. The geophones are placed in, for example, the secondary laterals to detect noises that result from the formation of a fracture as fracturing fluid is pumped into the primary lateral. Additionally, as the generated fracture propagates towards a secondary lateral and intersects with the secondary lateral, noise is generated. This noise is detected by the geophones, and locations of injection points that align with the injection points used to generate the fracture are detected. In this way, injection points located along fracture planes are located where secondary perforations may be formed.

Figure 7:
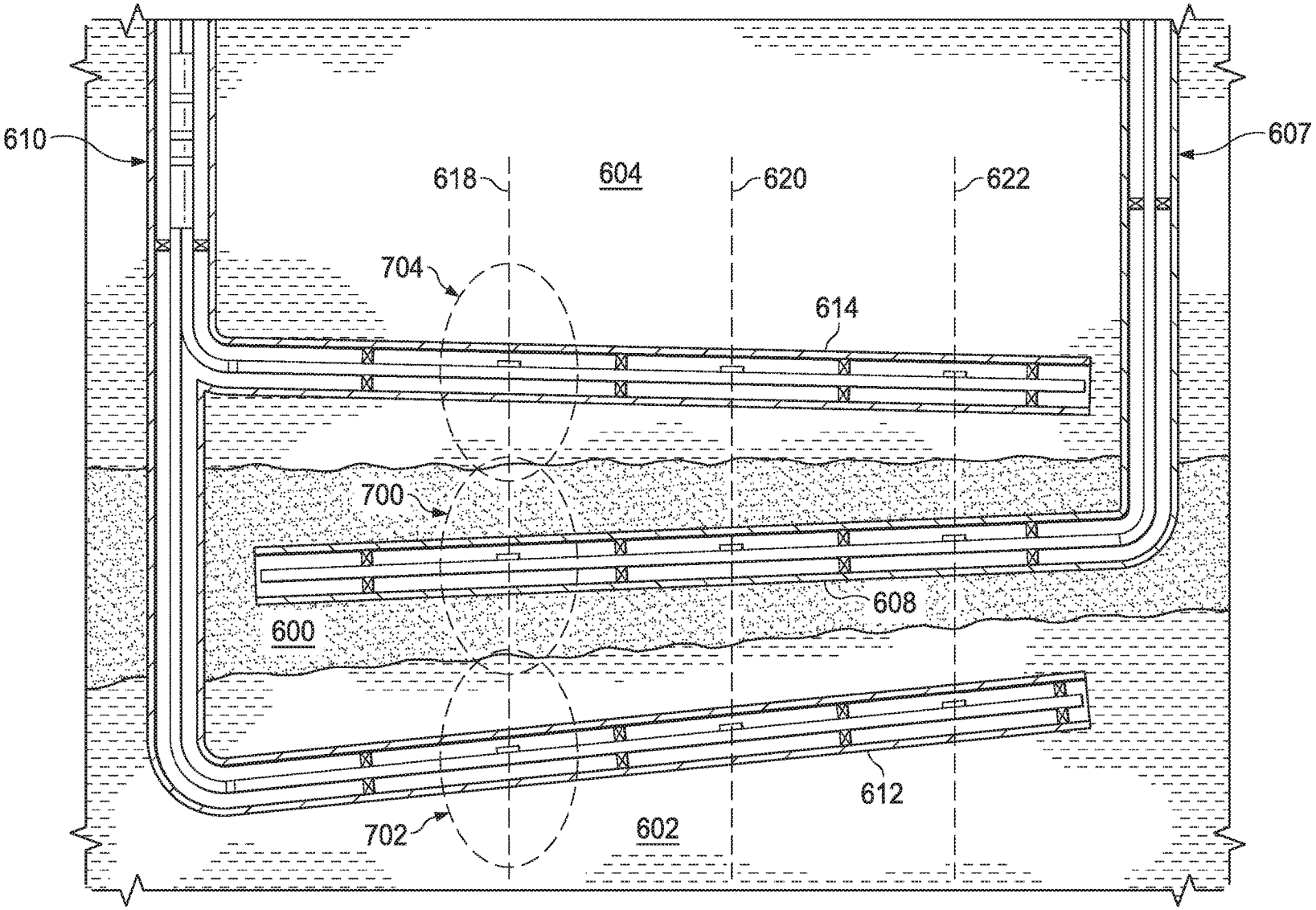
FIG. 7 is a cross-sectional view of the formations of FIG. 6A with competing fractures extending from a primary lateral portion and two adjacent lateral well portions, according to some implementations of the present disclosure.

FIG. 7 shows the target formation 600 and secondary formations 602 and 604 but also shows opposing and competing simultaneous fracturing treatments that form in-situ dynamic barriers. In the described implementations, three separate simultaneous fracturing treatments are applied along the lateral portions 608, 612, and 614 due to the presence of the three fracturing planes 618, 620, and 622. In other implementations having a different number of fracturing planes, a corresponding number of simultaneous fracturing treatments would be applied.

In the illustrated example, simultaneous fracturing treatments are applied along fracture plane 618. An acid fracturing treatment is applied to the target formation 600 at the injection point 616 along the fracture plane 618. The acid fracturing treatment may be similar to the acid fracturing treatment described earlier and forms a fracture 700 in the target formation 600. At the same time, a fracturing treatment is applied to each of the secondary formations 602 and 604 at corresponding injection points 616 along the fracture plane 618. The fracturing treatments form fractures 702 and 704, respectively. As described earlier, a fracturing fluid used to form fractures 702 and 704 may include one or more neutralizing additives and one or more sealing agent additives. The neutralizing additives and sealing agent additives may be of the types described earlier.

As the growing fracture 700 begins to interfere with the growing fractures 702 and 704, in-situ dynamic barriers form. The in-situ dynamic barriers prevent the acid used to form fracture 700 from intruding into the secondary formations 602 and 604. The acid is neutralized by acid neutralizing agents in the fracturing fluid used to form the fractures 702 and 704. Consequently, the acid is prevented from entering the secondary formations 602 and 604, and formation of wormholes in the secondary formations 602 and 604 is prevented. Further, sealing agent additives included in the fracturing fluids used to form fractures 702 and 704 form a seal in the rock along the in-situ dynamic barriers. These seals formed in the rock prevent or reduce conductivity of water from the secondary formations 602 and 604. Consequently, water infiltration into the wormholes of the fracture 700 is reduced, such that water production from the primary well 607 is reduced.

Figure 8:
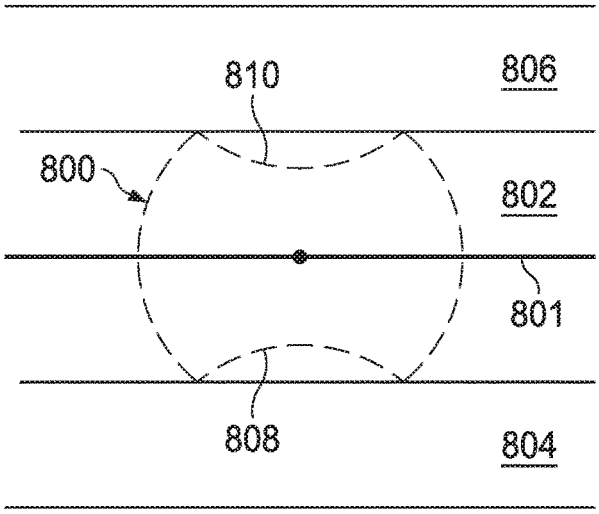
FIG. 8 is a cross-sectional view of the formation of FIG. 6A showing a fracture formed in the target formation, according to some implementations of the present disclosure.

FIG. 8 shows a resulting fracture 800 that is formed in the context of a well configuration similar to that shown in FIGS. 6A-7. A lateral well portion 801 is shown extending through a target formation 802. The fracture 800 is disposed in the target formation 802 and extends towards adjacent secondary formations 804 and 806 but is entirely contained within the target formation 802. The fracture 800 has a truncated shape at opposing ends 808 and 810. The truncated shape of the ends 808 and 810 follows the in-situ dynamic barriers that were created as a result of the opposing and competing simultaneous fracturing treatments.

Figure 9:
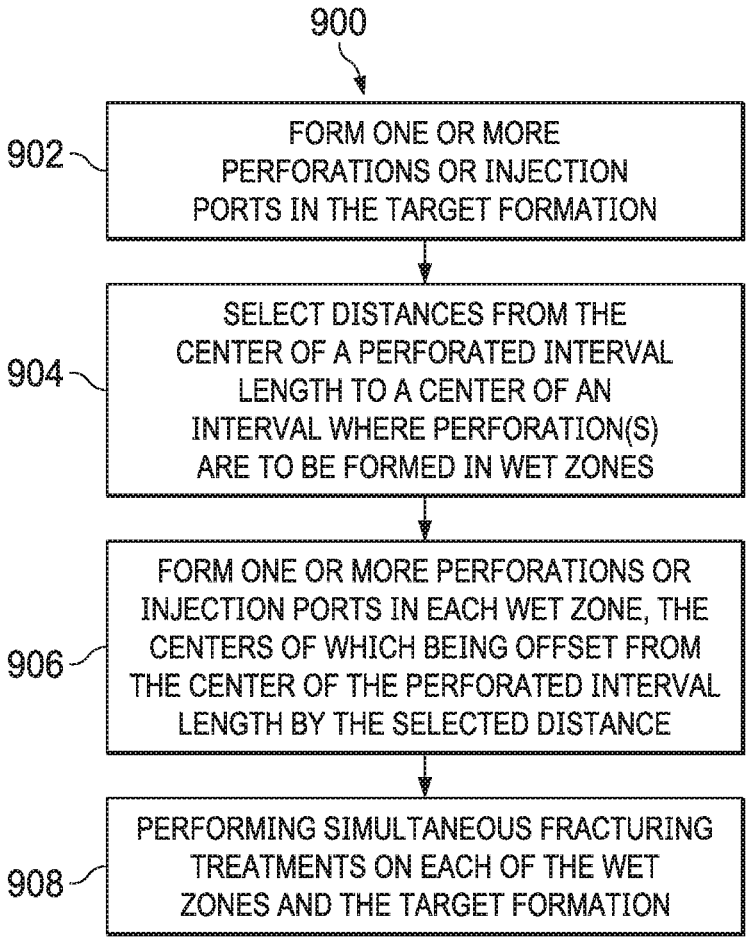
FIG. 9 is an example method of simultaneously fracturing a target formation and one or more adjacent secondary formations through a vertical well to form in-situ barriers at an interface between the competing fracturing treatments, according to some implementations of the present disclosure.

FIG. 9 is a flowchart of an example method 900 of forming a fracture in a target formation using in-situ dynamic barriers. The target formation is a carbonate hydrocarbon-bearing formation. The example method 900 is made in the context of a target formation that is flanked by adjacent wet zones. The target formation may be a hydrocarbon-bearing formation and may be similar to the target formation 202 shown in FIG. 2. The wet zones may be similar to wet zones 204 and 206 shown in FIG. 2. One of the wet zones may be disposed uphole of the target formation, and a second formation may be disposed downhole the target formation. At 902, one or more perforations are formed in the target formation. In some implementations, the one or more perforations may be in the form of injection ports. The perforations may be formed in the target formation via a wellbore extending through the formation. In some instances, the wellbore may be a vertical wellbore. In some instances, the one or more perforations may be a plurality of perforations formed in the target formation along a length the wellbore and may be referred to as a perforated interval length, Z. At 904, distances, S1 and S1, from a center of perforated interval length, Z, to a location or zone in which perforations or one or more injection ports are to be formed in the adjacent wet zones are selected. That is, S1 and S2 are the mid-perforation spacings between a center of the perforated interval length, Z, and center of a perforated zone to be formed within each of the wet zones, respectively. S1 and S2 are selected such that $R+Z/2 \leq S1$, $S2 \leq 2R$, where R is a fracture half length. In some instances, R corresponds to half of the fracture height of an idealized radial fracture. The values Z and R may be determined according to the considerations described earlier. While step 904 contemplates adjacent wet zones disposed vertically above or uphole of and vertically below or downhole of the target formation, the example method described is applicable to a scenario in which a single wet zone is disposed adjacent to the target formation, whether uphole or downhole of the target formation.

At 906, one or more perforations or one or more injection ports are formed within each wet zone along a length of the wellbore. The one or more perforations are displaced from the perforated interval within the target formation at lengths S1 and S2, respectively. In some instances, the perforations may be formed in one or more of the target formation, first wet zone, or second wet zone using a perforation string.

At 908, simultaneous fracturing treatments are applied to each of the target formation and the wet zones. The simultaneous fracturing treatments are applied to the one or more perforations formed in the respective target formation and wet zones. The simultaneous fracturing treatments initiate and grow a fracture in the respective regions. As the generated fractures grow, the fracture formed in the target formation begins to interfere with the fractures growing in the adjacent wet zones. Interference between the fracturing treatments forms in-situ dynamic barriers between the fracture in the target formation and the fractures in the wet zones. Acid in the fracturing fluid used to generate wormholes in the carbonate target formation is neutralized by one or more neutralizing agents included in the fracturing fluid used to fracture the wet zones. The rock surrounding the in-situ dynamic barriers is also sealed by one or more sealing agent additives also included in the fracturing fluid used in the wet zones. The seals prevent or reduce water from the wet zones from entering the fracture formed in the target formation. Consequently, wormhole formation in the wet zones is prevented or reduced and water production from the well as a result of water from the wet zones is prevented or reduced.

Other methods within the scope of the present disclosure may include additional, different, or fewer steps than described. Further, the order in which the steps are performed may be different. For example, the method may include one or more of drilling the well, installing a casing in the well, and installing a completion in the well.

Figure 10:
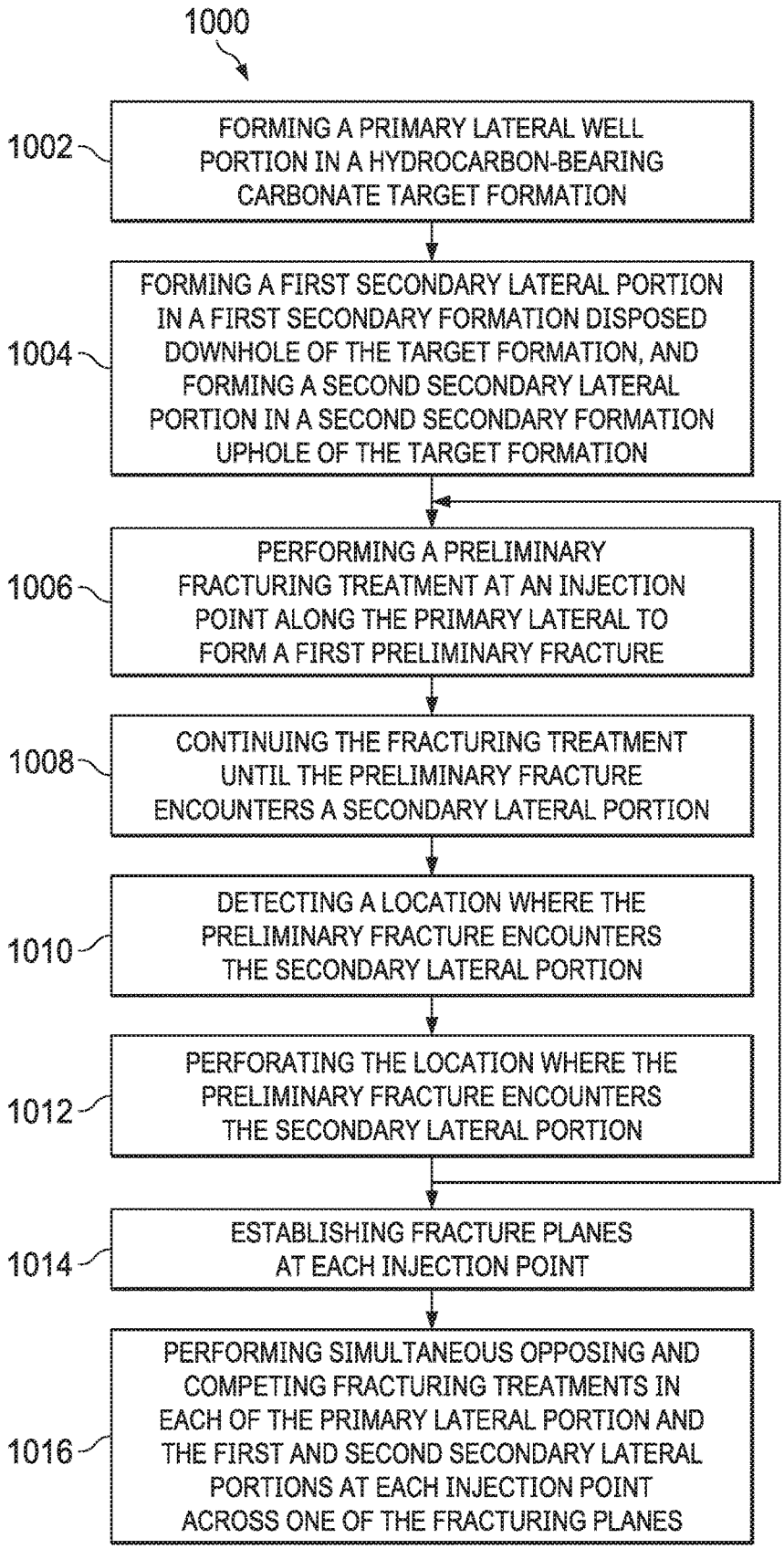
FIG. 10 is an example method of simultaneously fracturing a target formation and one or more adjacent secondary formations through horizontal wells to form in-situ barriers at an interface between the competing fracturing treatments, according to some implementations of the present disclosure.

FIG. 10 is a flowchart for another example method 1000 of forming a fracture in a target formation using in-situ dynamic barriers. At 1002, a primary lateral well portion is formed in a hydrocarbon-bearing carbonate target formation. At 1004, a first secondary lateral portion is formed in a first secondary formation disposed downhole of the target formation, and a second secondary lateral portion is formed in a second secondary formation disposed uphole of the target formation. The first and second secondary lateral formations may be wet zones. Although step 1004 contemplates adjacent wet zones disposed uphole and downhole of the target formation, the example method described is applicable to a scenario in which a single wet zone is disposed adjacent to the target formation, whether uphole or downhole of the target formation. Vertical placement of the first and second secondary lateral portions may be vertically offset from the primary lateral portion by an amount such that a fracture formed by a fracturing treatment in the primary lateral portion will expand to encounter the first and second secondary lateral portions.

At 1006, a preliminary fracturing treatment is performed at a location along the primary lateral to form a first preliminary fracture. In some implementations, the fluid used to perform the preliminary fracturing treatment may be cross-linked pad. In some instances, the preliminary fracturing treatment may occur at an injection point corresponding to injection ports formed in a completion string disposed in the primary lateral portion. At 1008, the fracturing treatment is continued until the preliminary fracture encounters one of the second secondary lateral portions. At 1010, a location where the preliminary fracture encounters the secondary lateral portion is detected. At 1012, the location where the preliminary fracture encounters the secondary lateral portion is perforated. Perforation of the secondary lateral portion at the location may be performed by a hydrajet perforating technique.

Steps 1006 through 1012 are repeated for each injection point along the primary lateral portion. A perforation or a perforation interval may be formed at each injection point. Further, a location where each of the preliminary fractures encounters the first secondary lateral portion may be detected thermally or acoustically. For example, a thermal sensor may be used to detect the location where the preliminary fractures encounter the first secondary lateral portion. The thermal sensor may detect a temperature change at the location where the preliminary fractures encounter the first secondary lateral portion. In some instances, the thermal sensor may detect a cool-down or drop in temperature where the preliminary fractures encounter the first secondary lateral portion. In other implementations, locations where the preliminary fractures encounter the first secondary lateral portion may be detected acoustically. Still further, any method, system, or apparatus that is capable of detecting a location where the preliminary fractures encounter the first secondary lateral portion may be used.

The thermal sensor may be a DTS sensor. The thermal sensor may be included in a coiled tubing inserted into the first secondary lateral portion. In some implementations, the coiled tubing may be used both to detect the location along the secondary lateral portion that is encountered by the preliminary fracture and to perforate the detected location of the secondary lateral portion.

Steps 1006 through 1012 are again repeated with respect to the second secondary lateral portion. The preliminary fracturing treatments are repeated and the locations where the preliminary fractures encounter the second secondary lateral portion are detected. The locations may be detected in ways similar to those explained earlier. For example, a thermal sensor, such as a DTS, may be used to detect locations where the preliminary fractures encounter the second secondary lateral portion. In some instances, a separate thermal sensor may be inserted into each of the secondary lateral portions, and the location along each secondary lateral portion may be detected simultaneously during a preliminary fracturing treatment. Also, the detected locations may be perforated by a separate perforating tools disposed in each of the secondary lateral portions. By inserting separate detections devices, such as, for example, a thermal sensor or acoustic sensor, into each of the secondary lateral portions, the preliminary fracturing operations can be performed a single time to detect the locations in both secondary lateral portions for each preliminary fracturing treatment performed at each injection point.

At step 1014, fracture planes are established at each injection point. Each fracture plane extends through an injection point in the primary lateral portion and the corresponding locations in the secondary lateral portions where the preliminary fractures extending from the particular injection point encounter the secondary lateral portions. At 1016, simultaneous opposing and competing fracturing treatments are performed in each of the primary lateral portion and the first and second secondary lateral portions at each injection point across one of the fracturing planes. The fracturing treatment performed at the injection point at the primary lateral portion is an acid fracturing treatment. The corresponding fracturing treatments performed at the detected locations in the secondary lateral portions contain one or more acid neutralizing agents and one or more sealing agent additives. As explained earlier, the competing fracturing treatments engage each other to form in-situ dynamic barriers that prevent or reduce the formation of wormholes within the secondary formations and seals the surrounding rock to prevent or reduce water conductivity from the secondary formation into the primary formation.

During formation of the fracture planes, the injection points used to define a particular fracture plane in each of the primary and secondary lateral wells may be isolated during formation of the particular fracture plane. In some implementations, isolation packers may be used to isolate the injection points. Isolation of the associated injection points across the primary and secondary lateral wells in this way promotes stimulation of the fracture plane during formation. The injection points associated with each fracture plane may be isolated in this manner.

In some implementations, the primary and secondary lateral portions may be laterals of a dual lateral horizontal well. Thus, in some implementations, a dual string completion may be used to simultaneously apply two separate fracturing treatments in the lateral portions. Other methods within the scope of the present disclosure may include additional, different, or fewer steps than described. Further, the order in which the steps are performed may be different. For example, the method may include one or more of drilling the wells, installing a casing in the wells, and installing a completion in the wells.

Figure 11:
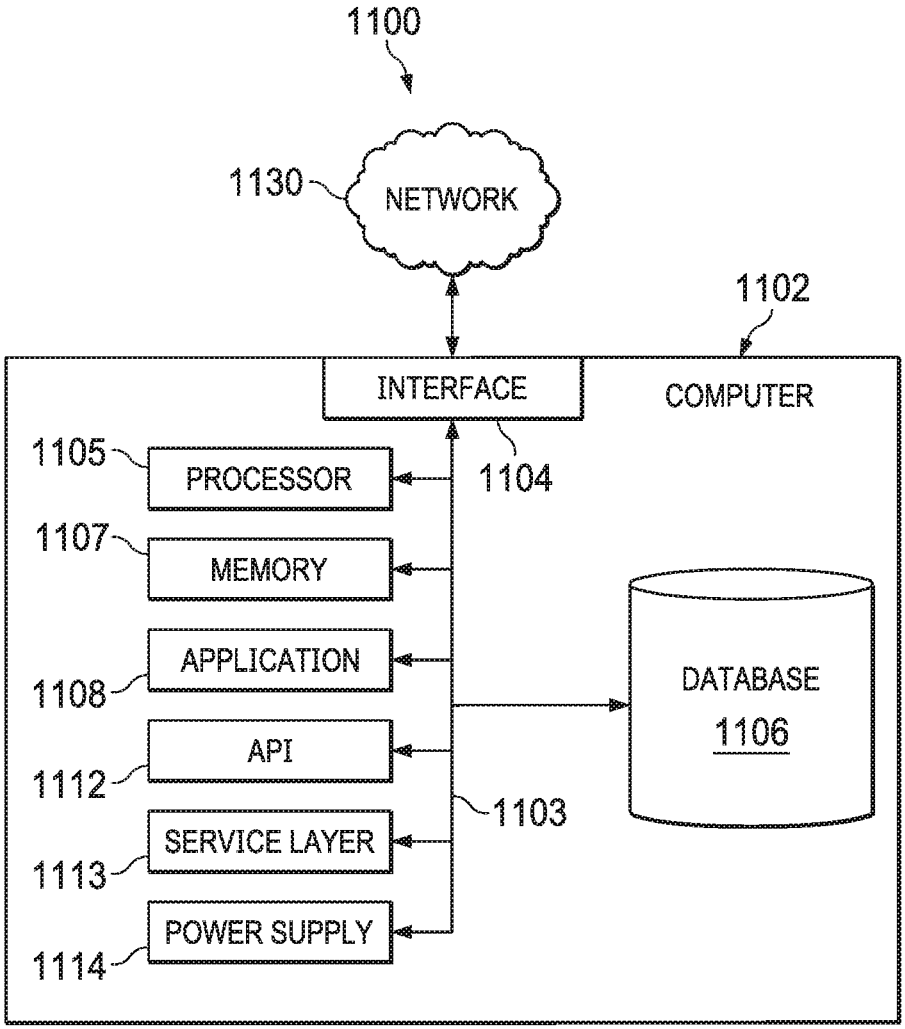
FIG. 11 is a block diagram illustrating an example implementation of a computer system used to provide computational functionalities associated with described algorithms, methods, functions, processes, flows, and procedures as described in the present disclosure, according to some implementations of the present disclosure.

FIG. 11 is a block diagram of an example computer system 1100 used to provide computational functionalities associated with described algorithms, methods, functions, processes, flows, and procedures described in the present disclosure, according to some implementations of the present disclosure. The illustrated computer 1102 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 1102 can include input devices such as keypads, keyboards, and touch screens that can accept user information. Also, the computer 1102 can include output devices that can convey information associated with the operation of the computer 1102. The information can include digital data, visual data, audio information, or a combination of information. The information can be presented in a graphical user interface (UI) (or GUI).

The computer 1102 can serve in a role as a client, a network component, a server, a database, a persistency, or components of a computer system for performing the subject matter described in the present disclosure. The illustrated computer 1102 is communicably coupled with a network 1130. In some implementations, one or more components of the computer 1102 can be configured to operate within different environments, including cloud-computing-based environments, local environments, global environments, and combinations of environments.

At a high level, the computer 1102 is an electronic computing device operable to receive, transmit, process, store, and manage data and information associated with the described subject matter. According to some implementations, the computer 1102 can also include, or be communicably coupled with, an application server, an email server, a web server, a caching server, a streaming data server, or a combination of servers.

The computer 1102 can receive requests over network 1130 from a client application (for example, executing on another computer 1102). The computer 1102 can respond to the received requests by processing the received requests using software applications. Requests can also be sent to the computer 1102 from internal users (for example, from a command console), external (or third) parties, automated applications, entities, individuals, systems, and computers.

Each of the components of the computer 1102 can communicate using a system bus 1103. In some implementations, any or all of the components of the computer 1102, including hardware or software components, can interface with each other or the interface 1104 (or a combination of both), over the system bus 1103. Interfaces can use an application programming interface (API) 1112, a service layer 1113, or a combination of the API 1112 and service layer 1113. The API 1112 can include specifications for routines, data structures, and object classes. The API 1112 can be either computer-language independent or dependent. The API 1112 can refer to a complete interface, a single function, or a set of APIs.

The service layer 1113 can provide software services to the computer 1102 and other components (whether illustrated or not) that are communicably coupled to the computer 1102. The functionality of the computer 1102 can be accessible for all service consumers using this service layer. Software services, such as those provided by the service layer 1113, can provide reusable, defined functionalities through a defined interface. For example, the interface can be software written in JAVA, C++, or a language providing data in extensible markup language (XML) format. While illustrated as an integrated component of the computer 1102, in alternative implementations, the API 1112 or the service layer 1113 can be stand-alone components in relation to other components of the computer 1102 and other components communicably coupled to the computer 1102. Moreover, any or all parts of the API 1112 or the service layer 1113 can be implemented as child or sub-modules of another software module, enterprise application, or hardware module without departing from the scope of the present disclosure.

The computer 1102 includes an interface 1104. Although illustrated as a single interface 1104 in FIG. 11, two or more interfaces 1104 can be used according to particular needs, desires, or particular implementations of the computer 1102 and the described functionality. The interface 1104 can be used by the computer 1102 for communicating with other systems that are connected to the network 1130 (whether illustrated or not) in a distributed environment. Generally, the interface 1104 can include, or be implemented using, logic encoded in software or hardware (or a combination of software and hardware) operable to communicate with the network 1130. More specifically, the interface 1104 can include software supporting one or more communication protocols associated with communications. As such, the network 1130 or the interface's hardware can be operable to communicate physical signals within and outside of the illustrated computer 1102.

The computer 1102 includes a processor 1105. Although illustrated as a single processor 1105 in FIG. 11, two or more processors 1105 can be used according to particular needs, desires, or particular implementations of the computer 1102 and the described functionality. Generally, the processor 1105 can execute instructions and can manipulate data to perform the operations of the computer 1102, including operations using algorithms, methods, functions, processes, flows, and procedures as described in the present disclosure.

The computer 1102 also includes a database 1106 that can hold data for the computer 1102 and other components connected to the network 1130 (whether illustrated or not). For example, database 1106 can be an in-memory, conventional, or a database storing data consistent with the present disclosure. In some implementations, database 1106 can be a combination of two or more different database types (for example, hybrid in-memory and conventional databases) according to particular needs, desires, or particular implementations of the computer 1102 and the described functionality. Although illustrated as a single database 1106 in FIG. 11, two or more databases (of the same, different, or combination of types) can be used according to particular needs, desires, or particular implementations of the computer 1102 and the described functionality. While database 1106 is illustrated as an internal component of the computer 1102, in alternative implementations, database 1106 can be external to the computer 1102.

The computer 1102 also includes a memory 1107 that can hold data for the computer 1102 or a combination of components connected to the network 1130 (whether illustrated or not). Memory 1107 can store any data consistent with the present disclosure. In some implementations, memory 1107 can be a combination of two or more different types of memory (for example, a combination of semiconductor and magnetic storage) according to particular needs, desires, or particular implementations of the computer 1102 and the described functionality. Although illustrated as a single memory 1107 in FIG. 11, two or more memories 1107 (of the same, different, or combination of types) can be used according to particular needs, desires, or particular implementations of the computer 1102 and the described functionality. While memory 1107 is illustrated as an internal component of the computer 1102, in alternative implementations, memory 1107 can be external to the computer 1102.

The application 1108 can be an algorithmic software engine providing functionality according to particular needs, desires, or particular implementations of the computer 1102 and the described functionality. For example, application 1108 can serve as one or more components, modules, or applications. Further, although illustrated as a single application 1108, the application 1108 can be implemented as multiple applications 1108 on the computer 1102. In addition, although illustrated as internal to the computer 1102, in alternative implementations, the application 1108 can be external to the computer 1102.

The computer 1102 can also include a power supply 1114. The power supply 1114 can include a rechargeable or non-rechargeable battery that can be configured to be either user- or non-user-replaceable. In some implementations, the power supply 1114 can include power-conversion and management circuits, including recharging, standby, and power management functionalities. In some implementations, the power-supply 1114 can include a power plug to allow the computer 1102 to be plugged into a wall socket or a power source to, for example, power the computer 1102 or recharge a rechargeable battery.

There can be any number of computers 1102 associated with, or external to, a computer system containing computer 1102, with each computer 1102 communicating over network 1130. Further, the terms "client," "user," and other appropriate terminology can be used interchangeably, as appropriate, without departing from the scope of the present disclosure. Moreover, the present disclosure contemplates that many users can use one computer 1102 and one user can use multiple computers 1102.

Described implementations of the subject matter can include one or more features, alone or in combination.

For example, in a first implementation, a computer-implemented method of performing simultaneous and competing fracturing operations in adjacent formations to form in-situ dynamic barriers between the competing fracturing treatments, the method including perforating an interval of a target formation; determining a mid-perforation separation distance extending from a center of the target formation perforated interval to a center of a perforation interval to be formed in a secondary formation, the secondary formation including a first wet zone; perforating an interval of the secondary formation, a center of the perforated interval formed in the secondary formation being separated from the center of the perforated interval of the target formation by the mid-perforation separation distance such that a fracture to be formed in the target formation overlaps a fracture to be formed in the secondary formation; applying, simultaneously, a first fracturing treatment to the perforated interval of the target formation, the first fracturing treatment including an acid fracturing treatment, and a second fracturing treatment to the perforated interval of the secondary formation, the second fracturing treatment including a neutralizing additive and a sealing agent additive; and growing a first fracture formed by the first fracturing treatment and a second fracture formed by the second fracturing treatment to cause the first fracture and the second fracture to interfere with each other thereby forming in-situ dynamic barriers, the neutralizing additive neutralizing acid of the acid fracturing treatment to prevent intrusion of the acid into the secondary formation and the sealing agent additive sealing formation rock at a location of the in-situ dynamic barrier to alter water conductivity in the sealed formation rock.

The foregoing and other described implementations can each, optionally, include one or more of the following features:

A first feature, combinable with any of the following features, wherein perforating the interval of the target formation and perforating the interval of the secondary formation may be performed at respective locations along a vertical well.

A second feature, combinable with any of the previous or following features, wherein the mid-perforation separation distance is determined according to the following relationships: $S1 \leq R+(Z/2)$ and $S1 \leq 2R$ or according to the following equations: $S1 \leq (H/2)+(Z/2)$; $S1 \leq H$; and $R>(H/2)$, where S1 is the mid-perforation separation distance; R is a fracture half-length of a fully developed fracture formed in the target formation as a result of the first fracturing treatment; H is a height of the fully developed fracture in the target formation as a result of the first fracturing treatment; and Z is a length of the perforated interval of the primary formation.

A third feature, combinable with any of the previous or following features, wherein the target formation is a carbonate formation.

A fourth feature, combinable with any of the previous or following features, wherein the acid is selected from a group consisting of hydrochloric acid (HCl), emulsified HCl, retarded acid systems, acetic acid, formic acid, and chelating agents.

A fifth feature, combinable with any of the previous or following features, wherein the neutralizing additive is selected from a group consisting of calcium carbonate, sodium hydroxide, soda ash, and sodium carbonate the neutralizing additive is selected from a group consisting of calcium carbonate, sodium hydroxide, soda ash, and sodium carbonate.

A sixth feature, combinable with any of the previous or following features, wherein the sealing agent additive is selected from the group consisting of Portland cement, aluminate cement, epoxy resin, phenolic resin, natural rubber, latex, and silicone.

A seventh feature, combinable with any of the previous or following features, wherein the secondary formation is a first secondary formation and further including determining a mid-separation distance extending from the center of the perforated interval of the target formation to a center of a perforated interval to be formed in a second secondary formation, the second secondary formation including a second wet zone.

An eight feature, combinable with any of the previous or following features, wherein the mid-perforation separation distance is determined according to the following relationships: $S1 \leq R+(Z/2)$; $S1 \leq 2R$; and $S1=S2$, or according to the following equations: $S1 \leq (H/2)+(Z/2)$; $S1 \leq H$; $S1=S2$; and $R>(H/2)$, wherein S1 is the mid-perforation separation distance extending from the center of the perforated interval of the target formation and the center of the perforated interval formed in the first secondary formation; S2 is the mid-perforation separation distance extending from the center of the perforated interval of the target formation and a center of the perforated interval to be formed in the second secondary formation; R is a fracture half-length of a fully developed fracture formed in the target formation as a result of first fracturing treatment; H is a height of the fully developed fracture in the target formation as a result of the first fracturing treatment; and Z is a length of the perforated interval of the primary formation.

A ninth feature, combinable with any of the previous or following features, the method further including perforating an interval of the second secondary formation disposed on a side of the target formation opposite the first secondary formation, the center of the perforated interval of the second secondary formation offset from the perforated interval of the target formation by the mid-perforation separation distance S2.

A tenth feature, combinable with any of the previous or following features, the method further including performing a third fracturing treatment to the perforated interval of the second secondary formation, the third fracturing treatment being performed simultaneously with the first fracturing treatment and the second fracturing treatment, wherein the first fracturing treatment includes an acid fracturing treatment, wherein the second fracturing treatment includes a neutralizing additive and a sealing agent additive, and wherein the third fracturing treatment includes a neutralizing additive and a sealing agent additive.

In a second implementation, an apparatus for performing simultaneous and competing fracturing operations in adjacent formations to form in-situ dynamic barriers between the competing fracturing treatments may include: one or more processors and a non-transitory computer-readable storage medium coupled to the one or more processors and storing programming instructions for execution by the one or more processors. The programming instructions instruct the one or more processors to: perforate an interval of a target formation; determine a mid-perforation separation distance extending from a center of the target formation perforated interval to a center of a perforation interval to be formed in a secondary formation, the secondary formation including a first wet zone; perforate an interval of the secondary formation, a center of the perforated interval formed in the secondary formation being separated from the center of the perforated interval of the target formation by the mid-perforation separation distance such that a fracture to be formed in the target formation overlaps a fracture to be formed in the secondary formation; apply, simultaneously, a first fracturing treatment to the perforated interval of the target formation, the first fracturing treatment including an acid fracturing treatment, and a second fracturing treatment to the perforated interval of the secondary formation, the second fracturing treatment including a neutralizing additive and a sealing agent additive; and grow a first fracture formed by the first fracturing treatment and a second fracture formed by the second fracturing treatment to cause the first fracture and the second fracture to interfere with each other thereby forming in-situ dynamic barriers, the neutralizing additive neutralizing acid of the acid fracturing treatment to prevent intrusion of the acid into the secondary formation and the sealing agent additive sealing formation rock at a location of the in-situ dynamic barrier to alter water conductivity in the sealed formation rock.

The foregoing and other described implementations can each, optionally, include one or more of the following features:

A first feature, combinable with any of the following features, wherein the perforated interval of the target formation and perforated interval of the secondary formation are formed at respective locations along a vertical well.

A second feature, combinable with any of the previous or following features, wherein the mid-perforation separation distance is determined according to the following relationships:

$$S1 \leq R+(Z/2); \text{ and}$$

$$S1 \leq 2R,$$

or according to the following equations:

$$S1 \leq (H/2)+(Z/2);$$

$S1 \leq H$; and $R > (H/2)$, where S1 is the mid-perforation separation distance; R is a fracture half-length of a fully developed fracture formed in the target formation as a result of the first fracturing treatment; H is a height of the fully developed fracture in the target formation as a result of the first fracturing treatment; and Z is a length of the perforated interval of the primary formation.

A third feature, combinable with any of the previous or following features, wherein the target formation is a carbonate formation.

A fourth feature, combinable with any of the previous or following features, wherein the acid is selected from a group consisting of hydrochloric acid (HCl), emulsified HCl, retarded acid systems, acetic acid, formic acid, and chelating agents.

A fifth feature, combinable with any of the previous or following features, wherein the neutralizing additive is selected from a group consisting of calcium carbonate, sodium hydroxide, soda ash, and sodium carbonate.

A sixth feature, combinable with any of the previous or following features, wherein the sealing agent additive is selected from the group consisting of Portland cement, aluminate cement, epoxy resin, phenolic resin, natural rubber, latex, and silicone.

A seventh feature, combinable with any of the previous or following features, wherein the secondary formation is a first secondary formation and further including determining a mid-separation distance extending from the center of the perforated interval of the target formation to a center of a perforated interval to be formed in a second secondary formation, the second secondary formation including a second wet zone.

An eighth feature, combinable with any of the previous or following features, wherein the mid-perforation separation distance is determined according to the following relationships:

$S1 \leq R + (Z/2)$;

$S1 \leq 2R$; and $S1 = S2$, or according to the following equations:

$S1 \leq (H/2) + (Z/2)$;

$S1 \leq H$; and $S1 = S2$;

$R > (H/2)$, where S1 is the mid-perforation separation distance extending from the center of the perforated interval of the target formation and the center of the perforated interval formed in the first secondary formation; S2 is the mid-perforation separation distance extending from the center of the perforated interval of the target formation and a center of the perforated interval to be formed in the second secondary formation; R is a fracture half-length of a fully developed fracture formed in the target formation as a result of first fracturing treatment; H is a height of the fully developed fracture in the target formation as a result of the first fracturing treatment; and Z is a length of the perforated interval of the primary formation.

A ninth feature, combinable with any of the previous or following features, wherein the programming instructions are operable to instruct the one or more processors to perforate an interval of the second secondary formation disposed on a side of the target formation opposite the first secondary formation, the center of the perforated interval of the second secondary formation offset from the perforated interval of the target formation by the mid-perforation separation distance S2.

A tenth feature, combinable with any of the previous or following features, wherein the programming instructions are operable to instruct the one or more processors to perform a third fracturing treatment to the perforated interval of the second secondary formation, the third fracturing treatment being performed simultaneously with the first fracturing treatment and the second fracturing treatment.

An eleventh feature, combinable with any of the previous or following features, wherein the first fracturing treatment includes an acid fracturing treatment.

A twelfth feature, combinable with any of the previous or following features, wherein the second fracturing treatment includes a neutralizing additive and a sealing agent additive.

A thirteenth feature, combinable with any of the previous or following features, wherein the third fracturing treatment includes a neutralizing additive and a sealing agent additive.

In a third implementation, a computer-implemented method performed by one or more processors for performing simultaneous and competing fracturing operations in adjacent formations to form in-situ dynamic barriers between the competing fracturing treatments includes the following operations: perforating an interval of a target formation; determining a mid-perforation separation distance extending from a center of the target formation perforated interval to a center of a perforation interval to be formed in a secondary formation, the secondary formation including a first wet zone; perforating an interval of the secondary formation, a center of the perforated interval formed in the secondary formation being separated from the center of the perforated interval of the target formation by the mid-perforation separation distance such that a fracture to be formed in the target formation overlaps a fracture to be formed in the secondary formation; applying, simultaneously, a first fracturing treatment to the perforated interval of the target formation, the first fracturing treatment including an acid fracturing treatment, and a second fracturing treatment to the perforated interval of the secondary formation, the second fracturing treatment including a neutralizing additive and a sealing agent additive; and growing a first fracture formed by the first fracturing treatment and a second fracture formed by the second fracturing treatment to cause the first fracture and the second fracture to interfere with each other thereby forming in-situ dynamic barriers, the neutralizing additive neutralizing acid of the acid fracturing treatment to prevent intrusion of the acid into the secondary formation and the sealing agent additive sealing formation rock at a location of the in-situ dynamic barrier to alter water conductivity in the sealed formation rock.

The foregoing and other described implementations can each, optionally, include one or more of the following features:

A first feature, combinable with any of the following features, wherein the perforated interval of the target formation and perforated interval of the secondary formation are formed at respective locations along a vertical well.

A second feature, combinable with any of the previous or following features, wherein the mid-perforation separation distance is determined according to the following relationships:

$S1 \leq R+(Z/2)$; and $S1 \leq 2R$, or according to the following equations:

$S1 \leq (H/2)+(Z/2)$;

$S1 \leq H$; and $R>(H/2)$, where S1 is the mid-perforation separation distance; R is a fracture half-length of a fully developed fracture formed in the target formation as a result of the first fracturing treatment; H is a height of the fully developed fracture in the target formation as a result of the first fracturing treatment; and Z is a length of the perforated interval of the primary formation.

A third feature, combinable with any of the previous or following features, wherein the target formation is a carbonate formation.

A fourth feature, combinable with any of the previous or following features, wherein the acid is selected from a group consisting of hydrochloric acid (HCl), emulsified HCl, retarded acid systems, acetic acid, formic acid, and chelating agents.

A fifth feature, combinable with any of the previous or following features, wherein the neutralizing additive is selected from a group consisting of calcium carbonate, sodium hydroxide, soda ash, and sodium carbonate.

A sixth feature, combinable with any of the previous or following features, wherein the sealing agent additive is selected from the group consisting of Portland cement, aluminate cement, epoxy resin, phenolic resin, natural rubber, latex, and silicone.

A seventh feature, combinable with any of the previous or following features, wherein the secondary formation is a first secondary formation and further including determining a mid-separation distance extending from the center of the perforated interval of the target formation to a center of a perforated interval to be formed in a second secondary formation, the second secondary formation including a second wet zone.

An eighth feature, combinable with any of the previous or following features, wherein the mid-perforation separation distance is determined according to the following relationships:

$S1 \leq R+(Z/2)$;

$S1 \leq 2R$; and $S1=S2$, or according to the following equations:

$S1 \leq (H/2)+(Z/2)$;

$S1 \leq H$; and $S1=S2$;

$R>(H/2)$, where S1 is the mid-perforation separation distance extending from the center of the perforated interval of the target formation and the center of the perforated interval formed in the first secondary formation; S2 is the mid-perforation separation distance extending from the center of the perforated interval of the target formation and a center of the perforated interval to be formed in the second secondary formation; R is a fracture half-length of a fully developed fracture formed in the target formation as a result of first fracturing treatment; H is a height of the fully developed fracture in the target formation as a result of the first fracturing treatment; and Z is a length of the perforated interval of the primary formation.

A ninth feature, combinable with any of the previous or following features, wherein the programming instructions are operable to instruct the one or more processors to perforate an interval of the second secondary formation disposed on a side of the target formation opposite the first secondary formation, the center of the perforated interval of the second secondary formation offset from the perforated interval of the target formation by the mid-perforation separation distance S2.

A tenth feature, combinable with any of the previous or following features, wherein the programming instructions are operable to instruct the one or more processors to perform a third fracturing treatment to the perforated interval of the second secondary formation, the third fracturing treatment being performed simultaneously with the first fracturing treatment and the second fracturing treatment.

An eleventh feature, combinable with any of the previous or following features, wherein the first fracturing treatment includes an acid fracturing treatment.

A twelfth feature, combinable with any of the previous or following features, wherein the second fracturing treatment includes a neutralizing additive and a sealing agent additive.

A thirteenth feature, combinable with any of the previous or following features, wherein the third fracturing treatment includes a neutralizing additive and a sealing agent additive.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as standalone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks. Computer readable media can also include magneto optical disks and optical memory devices and technologies including, for example, digital video disc (DVD), CD ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium.

A number of embodiments of the present disclosure have been described. Nevertheless, it will be understood that various modifications may be made without departing from the spirit and scope of the present disclosure. For example, the preliminary fracturing treatments applied to the injection points in the primary lateral portion may be performed simultaneously. Accordingly, other embodiments are within the scope of the following claims.

What is claimed is:

1. A method of performing simultaneous and competing fracturing operations in adjacent formations to form in-situ dynamic barriers between the competing fracturing treatments, the method comprising:

perforating an interval of a target formation;

determining a mid-perforation separation distance extending from a center of the target formation perforated interval to a center of a perforation interval to be formed in a secondary formation, the secondary formation comprising a first wet zone;

perforating an interval of the secondary formation, a center of the perforated interval formed in the secondary formation being separated from the center of the perforated interval of the target formation by the mid-perforation separation distance such that a fracture to be formed in the target formation overlaps a fracture to be formed in the secondary formation;

applying, simultaneously, a first fracturing treatment to the perforated interval of the target formation, the first fracturing treatment comprising an acid fracturing treatment, and a second fracturing treatment to the perforated interval of the secondary formation, the second fracturing treatment comprising a first neutralizing additive and a first sealing agent additive, wherein the first neutralizing additive is selected from a group consisting of calcium carbonate, sodium hydroxide, and sodium carbonate; and growing a first fracture formed by the first fracturing treatment and a second fracture formed by the second fracturing treatment to cause the first fracture and the second fracture to interfere with each other thereby forming in-situ dynamic barriers, the first neutralizing additive neutralizing acid of the acid fracturing treatment to prevent intrusion of the acid into the secondary formation and the first sealing agent additive sealing formation rock at a location of the in-situ dynamic barrier to alter water conductivity in the sealed formation rock.

2. The method of claim 1, wherein perforating the interval of the target formation and perforating the interval of the secondary formation are performed at respective locations along a vertical well.

3. The method of claim 1, wherein the target formation is a carbonate formation.

4. The method of claim 1, wherein the acid is selected from a group consisting of hydrochloric acid (HCl), emulsified HCl, retarded acid systems, acetic acid, formic acid, and chelating agents.

5. The method of claim 1, wherein the first sealing agent additive is selected from the group consisting of Portland cement, aluminate cement, epoxy resin, phenolic resin, natural rubber, latex, and silicone.

6. The method of claim 1, wherein the secondary formation is a first secondary formation and further comprising determining a mid-separation distance extending from the center of the perforated interval of the target formation to a center of a perforated interval to be formed in a second secondary formation, the second secondary formation comprising a second wet zone.

7. The method of claim 6, further comprising perforating an interval of the second secondary formation disposed on a side of the target formation opposite the first secondary formation, the center of the perforated interval of the second secondary formation offset from the perforated interval of the target formation.

8. The method of claim 7, further comprising performing a third fracturing treatment to the perforated interval of the second secondary formation, the third fracturing treatment being performed simultaneously with the first fracturing treatment and the second fracturing treatment, wherein the first fracturing treatment comprises an acid fracturing treatment, wherein the second fracturing treatment comprises a second neutralizing additive and a second sealing agent additive, and wherein the third fracturing treatment comprises a third neutralizing additive and a third sealing agent additive.

9. A method of performing simultaneous and competing fracturing operations in adjacent formations to form in-situ dynamic barriers between the competing fracturing treatments, the method comprising:

perforating an interval of a target formation;

determining a mid-perforation separation distance extending from a center of the target formation perforated interval to a center of a perforation interval to be formed in a secondary formation, the secondary formation comprising a first wet zone;

perforating an interval of the secondary formation, a center of the perforated interval formed in the secondary formation being separated from the center of the perforated interval of the target formation by the mid-perforation separation distance such that a fracture to be formed in the target formation overlaps a fracture to be formed in the secondary formation;

applying, simultaneously, a first fracturing treatment to the perforated interval of the target formation, the first fracturing treatment comprising an acid fracturing treatment, and a second fracturing treatment to the perforated interval of the secondary formation, the second fracturing treatment comprising a neutralizing additive and a sealing agent additive, wherein the sealing agent additive is selected from the group consisting of Portland cement, aluminate cement, epoxy resin, phenolic resin, natural rubber, latex, and silicone; and growing a first fracture formed by the first fracturing treatment and a second fracture formed by the second fracturing treatment to cause the first fracture and the second fracture to interfere with each other thereby forming in-situ dynamic barriers, the neutralizing additive neutralizing acid of the acid fracturing treatment to prevent intrusion of the acid into the secondary formation and the sealing agent additive sealing formation rock at a location of the in-situ dynamic barrier to alter water conductivity in the sealed formation rock.

10. A method of performing simultaneous and competing fracturing operations in adjacent formations to form in-situ dynamic barriers between the competing fracturing treatments, the method comprising:

perforating an interval of a target formation;

determining a mid-perforation separation distance extending from a center of the target formation perforated interval to a center of a perforation interval to be formed in a secondary formation, the secondary formation comprising a first wet zone;

perforating an interval of the secondary formation, a center of the perforated interval formed in the secondary formation being separated from the center of the perforated interval of the target formation by the mid-perforation separation distance such that a fracture to be formed in the target formation overlaps a fracture to be formed in the secondary formation;

applying, simultaneously, a first fracturing treatment to the perforated interval of the target formation, the first fracturing treatment comprising an acid fracturing treatment, and a second fracturing treatment to the perforated interval of the secondary formation, the second fracturing treatment comprising a neutralizing additive and a sealing agent; and growing a first fracture formed by the first fracturing treatment and a second fracture formed by the second fracturing treatment to cause the first fracture and the second fracture to interfere with each other thereby forming in-situ dynamic barriers, the neutralizing additive neutralizing acid of the acid fracturing treatment to prevent intrusion of the acid into the secondary formation and the sealing agent additive sealing formation rock at a location of the in-situ dynamic barrier to alter water conductivity in the sealed formation rock;

wherein the secondary formation is a first secondary formation and further comprising determining a mid-separation distance extending from the center of the perforated interval of the target formation to a center of a perforated interval to be formed in a second secondary formation, the second secondary formation comprising a second wet zone.

* * * * *